US012674641B2

(12) United States Patent
Nerheim et al.

(10) Patent No.: US 12,674,641 B2
(45) Date of Patent: Jul. 7, 2026

(54) PROPULSION MODULE ASSEMBLY FOR A PROJECTILE LAUNCHER

(71) Applicant: Axon Enterprise, Inc., Scottsdale, AZ (US)

(72) Inventors: Magne H. Nerheim, Paradise Valley, AZ (US); Oleg Nemtyshkin, Scottsdale, AZ (US)

(73) Assignee: Axon Enterprise, Inc., Scottsdale, AZ (US)

( * ) Notice: Subject to any disclaimer, the term of this patent is extended or adjusted under 35 U.S.C. 154(b) by 0 days.

(21) Appl. No.: 18/655,636

(22) Filed: May 6, 2024

(65) Prior Publication Data

US 2024/0369321 A1 Nov. 7, 2024

Related U.S. Application Data

(60) Provisional application No. 63/464,151, filed on May 4, 2023.

(51) Int. Cl.
*F41B 11/62* (2013.01)
*F41B 11/71* (2013.01)
(Continued)

(52) U.S. Cl.
CPC ..... *F41B 11/71* (2013.01); *F41B 11/62* (2013.01); *F41B 11/80* (2013.01); *F41H 13/0012* (2013.01)

(58) Field of Classification Search
CPC ..... F41B 11/62; F41B 11/60; F41B 11/80; F41H 13/0025
See application file for complete search history.

(56) References Cited

U.S. PATENT DOCUMENTS 2,441,011 A * 5/1948 Dodelin ..... F16K 13/06 137/68.13
3,999,534 A * 12/1976 Chapin ..... F41B 11/62 124/49
(Continued)

FOREIGN PATENT DOCUMENTS

GB 2395543 A * 5/2004 ..... F41C 3/00
TW 201835522 A 10/2018
(Continued)

OTHER PUBLICATIONS

Taiwan Patent Office, Office Action for Taiwanese Application No. 113116551 mailed Mar. 13, 2025.
(Continued)

*Primary Examiner* — Jonathan C Weber
(74) *Attorney, Agent, or Firm* — H S. Malvich, Jr.; Andrew Graham

(57) ABSTRACT

A propulsion system for a projectile launcher may comprise a propulsion source, the propulsion source having a first end, a second end opposite the first end, and a propulsion source wall. A puncture structure having a fluid channel may be located proximate to the first end. A puncher may be located proximate to the second end and configured to translate the propulsion source from a first position to a second position. Translation of the propulsions source from the first position to the second position may fluidly connect the fluid channel and the propulsion source. The projectile launcher may be activated upon the propulsion source being fluidly connected to the fluid channel.

20 Claims, 10 Drawing Sheets

(51) Int. Cl.
*F41B 11/80* (2013.01)
*F41H 13/00* (2006.01)

(56) References Cited

U.S. PATENT DOCUMENTS

| | | | | |
|---|---|---|---|---|
| 4,026,188 | A * | 5/1977 | Woodruff | F42B 5/035 89/1.51 |
| 5,078,117 | A | 1/1992 | Cover | |
| 5,230,324 | A * | 7/1993 | Van Horssen | F41B 11/723 124/71 |
| 5,711,286 | A * | 1/1998 | Petrosyan | F41B 11/55 124/76 |
| 7,353,815 | B2 * | 4/2008 | Wei | F41B 11/56 124/45 |
| 9,435,619 | B1 | 9/2016 | Park | |
| 9,441,894 | B1 | 9/2016 | Moy | |
| 10,782,113 | B2 * | 9/2020 | Brundula | F42C 19/12 |
| 12,276,475 | B1 * | 4/2025 | Wei | F41B 11/89 |
| 2014/0338650 | A1 * | 11/2014 | Maeda | F41B 11/62 124/74 |
| 2015/0300771 | A1 * | 10/2015 | Tseng | F41B 11/62 124/74 |
| 2017/0153082 | A1 * | 6/2017 | Maeda | F41B 11/62 |
| 2020/0276026 | A1 | 9/2020 | Sanders et al. | |
| 2020/0400416 | A1 | 12/2020 | Brundula et al. | |
| 2021/0381797 | A1 * | 12/2021 | Buys | F41B 11/62 |
| 2025/0237467 | A1 * | 7/2025 | Riley | F41B 11/56 |

FOREIGN PATENT DOCUMENTS

| | | | |
|---|---|---|---|
| TW | M575097 | U | 3/2019 |
| TW | 202314187 | A | 4/2023 |

OTHER PUBLICATIONS

Korean Intellectual Property Office, International Search Report and Written Opinion for International Application No. PCT/US24/27728 mailed Aug. 30, 2024.

* cited by examiner

PROPULSION MODULE ASSEMBLY FOR A PROJECTILE LAUNCHER

FIELD OF THE INVENTION

Embodiments of the present disclosure relate to a projectile launcher.

DETAILED DESCRIPTION

Figure 1:
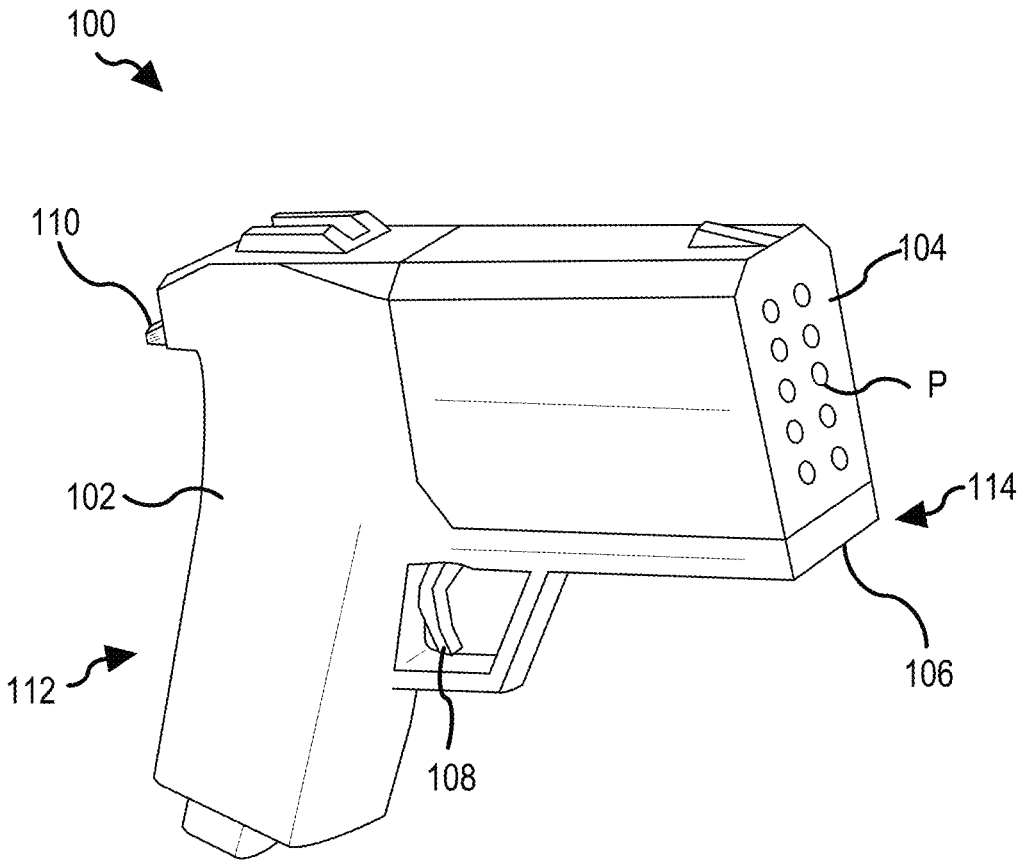
FIG. 1 is a perspective view of a projectile launcher, in accordance with various embodiments.

The detailed description of exemplary embodiments herein makes reference to the accompanying drawings, which show exemplary embodiments by way of illustration. While these embodiments are described in sufficient detail to enable those skilled in the art to practice the disclosures, it should be understood that other embodiments may be realized and that logical changes and adaptations in design and construction may be made in accordance with this disclosure and the teachings herein. Thus, the detailed description herein is presented for purposes of illustration only and not of limitation.

The scope of the disclosure is defined by the appended claims and their legal equivalents rather than by merely the examples described. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, coupled, connected, or the like may include permanent, removable, temporary, partial, full, and/or any other possible attachment option. Surface shading lines may be used throughout the figures to denote different parts but not necessarily to denote the same or different materials.

Systems, methods, and apparatuses may be used to interfere with voluntary locomotion (e.g., walking, running, moving, etc.) of a target. For example, a projectile launcher may be configured as a conducted electrical weapon ("CEW") used to deliver a current (e.g., stimulus signal, pulses of current, pulses of charge, etc.) through tissue of a human or animal target. Although generally referred to as a CEW, as described herein, the term CEW may refer to a conducted electrical weapon, a conducted energy weapon, and/or any other similar device or apparatus configured to provide a stimulus signal through one or more deployed projectiles (e.g., electrodes).

Systems, methods, and apparatuses may be used to interfere with, prevent, and/or otherwise disincentivize escalation and/or further interaction during an event. For example, a projectile launcher may be utilized to deploy a deterrent and/or other substance to a human or animal target that disincentivizes further interaction.

A stimulus signal carries a charge into target tissue. The stimulus signal may interfere with voluntary locomotion of the target. The stimulus signal may cause pain. The pain may also function to encourage the target to stop moving. The stimulus signal may cause skeletal muscles of the target to become stiff (e.g., lock up, freeze, etc.). The stiffening of the muscles in response to a stimulus signal may be referred to as neuromuscular incapacitation ("NMI"). NMI disrupts voluntary control of the muscles of the target. The inability of the target to control its muscles interferes with locomotion of the target.

A stimulus signal may be delivered through the target via terminals coupled to the projectile launcher while configured as a CEW. Delivery via terminals may be referred to as a local delivery (e.g., a local stun, a drive stun, etc.). During local delivery, the terminals are brought close to the target by positioning the CEW proximate to the target. The stimulus signal is delivered through the target's tissue via the terminals. To provide local delivery, the user of the CEW is generally within arm's reach of the target and brings the terminals of the CEW into contact with or proximate to the target.

A stimulus signal may be delivered through the target via one or more (typically at least two) wire-tethered electrodes. Delivery via wire-tethered electrodes may be referred to as a remote delivery (e.g., a remote stun). During a remote delivery, the CEW may be separated from the target up to the length (e.g., 15 feet, 20 feet, 30 feet, etc.) of the wire tether. The CEW launches the electrodes towards the target. As the electrodes travel toward the target, the respective wire tethers deploy behind the electrodes. The wire tether electrically couples the CEW to the electrode. The electrode may electrically couple to the target thereby coupling the CEW to the target. In response to the electrodes connecting with, impacting on, or being positioned proximate to the target's tissue, the current may be provided through the target via the electrodes (e.g., a circuit is formed through the first tether and the first electrode, the target's tissue, and the second electrode and the second tether).

Terminals or electrodes that contact or are proximate to the target's tissue deliver the stimulus signal through the target. Contact of a terminal or electrode with the target's tissue establishes an electrical coupling (e.g., circuit) with the target's tissue. Electrodes may include a spear that may pierce the target's tissue to contact the target. A terminal or electrode that is proximate to the target's tissue may use ionization to establish an electrical coupling with the target's tissue. Ionization may also be referred to as arcing.

In use (e.g., during deployment), a terminal or electrode may be separated from the target's tissue by the target's clothing or a gap of air. In various embodiments, a signal generator of the CEW may provide the stimulus signal (e.g., current, pulses of current, etc.) at a high voltage (e.g., in the range of 40,000 to 100,000 volts) to ionize the air in the clothing or the air in the gap that separates the terminal or electrode from the target's tissue. Ionizing the air establishes a low impedance ionization path from the terminal or electrode to the target's tissue that may be used to deliver the stimulus signal into the target's tissue via the ionization path. The ionization path persists (e.g., remains in existence, lasts, etc.) as long as the current of a pulse of the stimulus signal is provided via the ionization path. When the current ceases or is reduced below a threshold (e.g., amperage, voltage), the ionization path collapses (e.g., ceases to exist) and the terminal or electrode is no longer electrically coupled to the target's tissue. Lacking the ionization path, the impedance between the terminal or electrode and target tissue is high. A high voltage in the range of about 50,000 volts can ionize air in a gap of up to about one inch.

A CEW may provide a stimulus signal as a series of current pulses. Each current pulse may include a high voltage portion (e.g., 40,000-100,000 volts) and a low voltage portion (e.g., 500-6,000 volts). The high voltage portion of a pulse of a stimulus signal may ionize air in a gap between an electrode or terminal and a target to electrically couple the electrode or terminal to the target. In response to the electrode or terminal being electrically coupled to the target, the low voltage portion of the pulse delivers an amount of charge into the target's tissue via the ionization path. In response to the electrode or terminal being electrically coupled to the target by contact (e.g., touching, spear embedded into tissue, etc.), the high portion of the pulse and the low portion of the pulse both deliver charge to the target's tissue. Generally, the low voltage portion of the pulse delivers a majority of the charge of the pulse into the target's tissue. In various embodiments, the high voltage portion of a pulse of the stimulus signal may be referred to as the spark or ionization portion. The low voltage portion of a pulse may be referred to as the muscle portion.

In various embodiments, a signal generator of the CEW may provide the stimulus signal (e.g., current, pulses of current, etc.) at only a low voltage (e.g., less than 2,000 volts). The low voltage stimulus signal may not ionize the air in the clothing or the air in the gap that separates the terminal or electrode from the target's tissue. A CEW having a signal generator providing stimulus signals at only a low voltage (e.g., a low voltage signal generator) may require deployed electrodes to be electrically coupled to the target by contact (e.g., touching, spear embedded into tissue, etc.).

In various embodiments, a signal generator of the CEW may provide an activation signal and/or a pilot signal to a propulsion system of the CEW. The pilot signal may be utilized to determine that an electrical communication path (e.g., an electrical connection and/or signal pathway that enables signals, pulses of current, pulses of charge, and/or other electrical indications to be communicated, transferred, and/or otherwise transmitted between components) has been formed by the propulsion system. The activation signal may be utilized to activate the propulsion system to provide propellant to the CEW. The activation signal may be configured to generate thermal energy within the propulsion system that causes combustible material within a primer of the propulsion system to ignite. A primer may refer to a device that makes the propulsion system ready for use and/or action by forcing a propellant source (e.g., a cannister of propellant) to couple with a fluid channel within the propulsion system.

A CEW may include at least two terminals at the face of the CEW. A CEW may include two terminals for each bay that accepts a magazine (e.g., deployment unit). The terminals are spaced apart from each other. In response to the electrodes of the magazine in the bay having not been deployed, the high voltage impressed across the terminals will result in ionization of the air between the terminals. The arc between the terminals may be visible to the naked eye. In response to a launched electrode not electrically coupling to a target, the current that would have been provided via the electrodes may arc across the face of the CEW via the terminals.

The likelihood that the stimulus signal will cause NMI increases when the electrodes that deliver the stimulus signal are spaced apart at least 6 inches (15.24 centimeters) so that the current from the stimulus signal flows through the at least 6 inches of the target's tissue. In various embodiments, the electrodes preferably should be spaced apart at least 12 inches (30.48 centimeters) on the target. Because the terminals on a CEW are typically less than 6 inches apart, a stimulus signal delivered through the target's tissue via terminals likely will not cause NMI, only pain.

A series of pulses may include two or more pulses separated in time. Each pulse delivers an amount of charge into the target's tissue. In response to the electrodes being appropriately spaced (as discussed above), the likelihood of inducing NMI increases as each pulse delivers an amount of charge in the range of 55 microcoulombs to 71 microcoulombs per pulse. The likelihood of inducing NMI increases when the rate of pulse delivery (e.g., rate, pulse rate, repetition rate, etc.) is between 11 pulses per second ("pps") and 50 pps. Pulses delivered at a higher rate may provide less charge per pulse to induce NMI. Pulses that deliver more charge per pulse may be delivered at a lesser rate to induce NMI. In various embodiments, a CEW may be hand-held and use batteries to provide the pulses of the stimulus signal. In response to the amount of charge per pulse being high and the pulse rate being high, the CEW may use more energy than is needed to induce NMI. Using more energy than is needed depletes batteries more quickly.

Empirical testing has shown that the power of the battery may be conserved with a high likelihood of causing NMI in response to the pulse rate being less than 44 pps and the charge per a pulse being about 63 microcoulombs. Empirical testing has shown that a pulse rate of 22 pps and 63 microcoulombs per a pulse via a pair of electrodes will induce NMI when the electrode spacing is at least 12 inches (30.48 centimeters).

In various embodiments, a CEW may include a handle and one or more magazines. The handle may include one or more bays for receiving the magazine(s). Each magazine may be removably positioned in (e.g., inserted into, coupled to, etc.) a bay. Each magazine may releasably electrically, electronically, and/or mechanically couple to a bay. A deployment of the CEW may launch one or more electrodes from the magazine and toward a target to remotely deliver the stimulus signal through the target.

In various embodiments, a magazine may receive one or more electrodes (e.g., projectiles). In some embodiments, each projectile may be directly received in a magazine. For example, the magazine may comprise one or more firing tubes in which a respective projectile may be received prior to deployment. After a projectile is deployed, another projectile may be inserted in the magazine to permit launch of another projectile. Alternately or additionally, the magazine may receive one or more cartridges that each include one or more projectiles. For example, the magazine may comprise one or more firing tubes each receive a respective cartridge. In some embodiments, a cartridge may comprise a single projectile. For example, a CEW cartridge may comprise a single electrode. The single projectile may be individually deployed from the cartridge and the magazine in which the cartridge is received. Alternately, a cartridge may comprise two or more projectiles that are launched at the same time. Launching or deploying a projectile may be referred to as activating (e.g., firing) a cartridge. After use (e.g., activation, firing), a portion of a cartridge may remain in the magazine. After the use, the portion of the cartridge may be removed from the magazine and replaced with an unused (e.g., not fired, not activated) cartridge to permit launch of an additional projectile or projectiles.

In various embodiments, a CEW and/or a projectile launcher may include a propulsion system that causes one or more electrodes and/or projectiles to be launched. In various embodiments, the propulsion system may include a propulsion source, a puncture structure, and a puncher. The propulsion source may refer to a cannister that contains an amount of propellant that launches the one or more projectiles and is initially sealed at a sealed end, wherein the sealed end is puncturable by the puncture structure. The puncture structure may refer to a needle-like structure that includes a fluid channel allowing the propellant to leave the cannister once the puncture structure breaks the sealed end. The puncher may refer to a device located near a bottom end of the cannister that provides a push (e.g., a punch) to the cannister, wherein the bottom end is opposite the sealed end such that the puncher pushes the cannister onto the puncture structure.

In various embodiments, a puncher may be assembled from a puncher casing that defines an internal channel of the puncher, a puncher head that pushes a cannister into a puncture structure, a puncher drive that applies a force to the puncher head to push the cannister, and/or a puncher lock that secures the puncher head once the puncher head reaches a desired position. The puncher channel may extend between a first end and a second end of the puncher casing. The puncher drive may be located near the first end of the puncher casing and apply a force to the puncher head though expanding gases within the puncher channel. The puncher drive may apply the force to the puncher head via a drive portion that extends within the puncher channel. The puncher drive may utilize other force transfers to translate the puncher head. The puncher head may be within the puncher channel near the first end of the puncher casing and may be moved from the first end to the second end by the puncher drive. The puncher lock may refer to a locking ring or other lock that is located within the second end of the puncher casing and secures the puncher head near the second end of the puncher casing.

Examples of various exemplary embodiments embodying aspects of the invention are presented in the following example set. It will be appreciated that all examples contained in this disclosure are given by way of explanation, and not of limitation.

Figure 2:
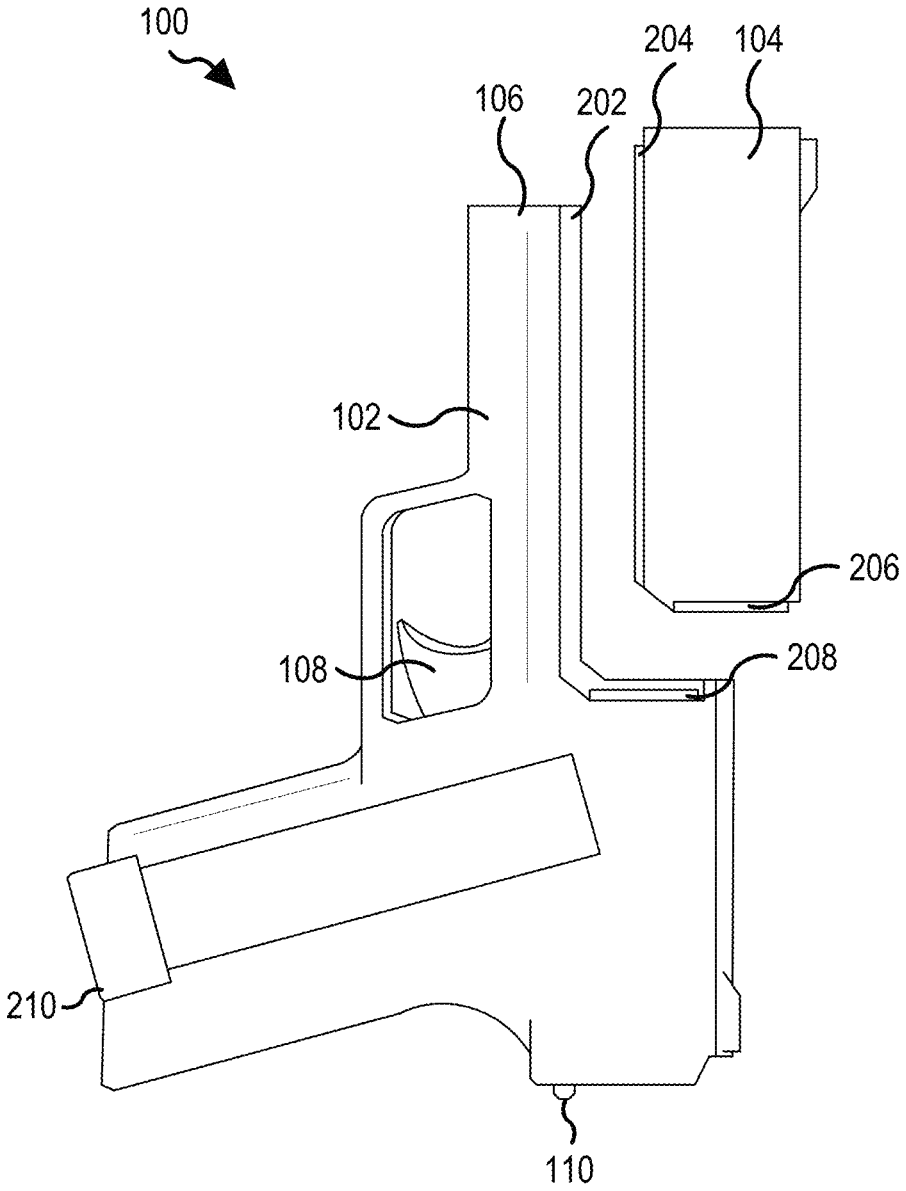
FIG. 2 is a perspective view of a projectile launcher, in accordance with various embodiments.
Figure 3:
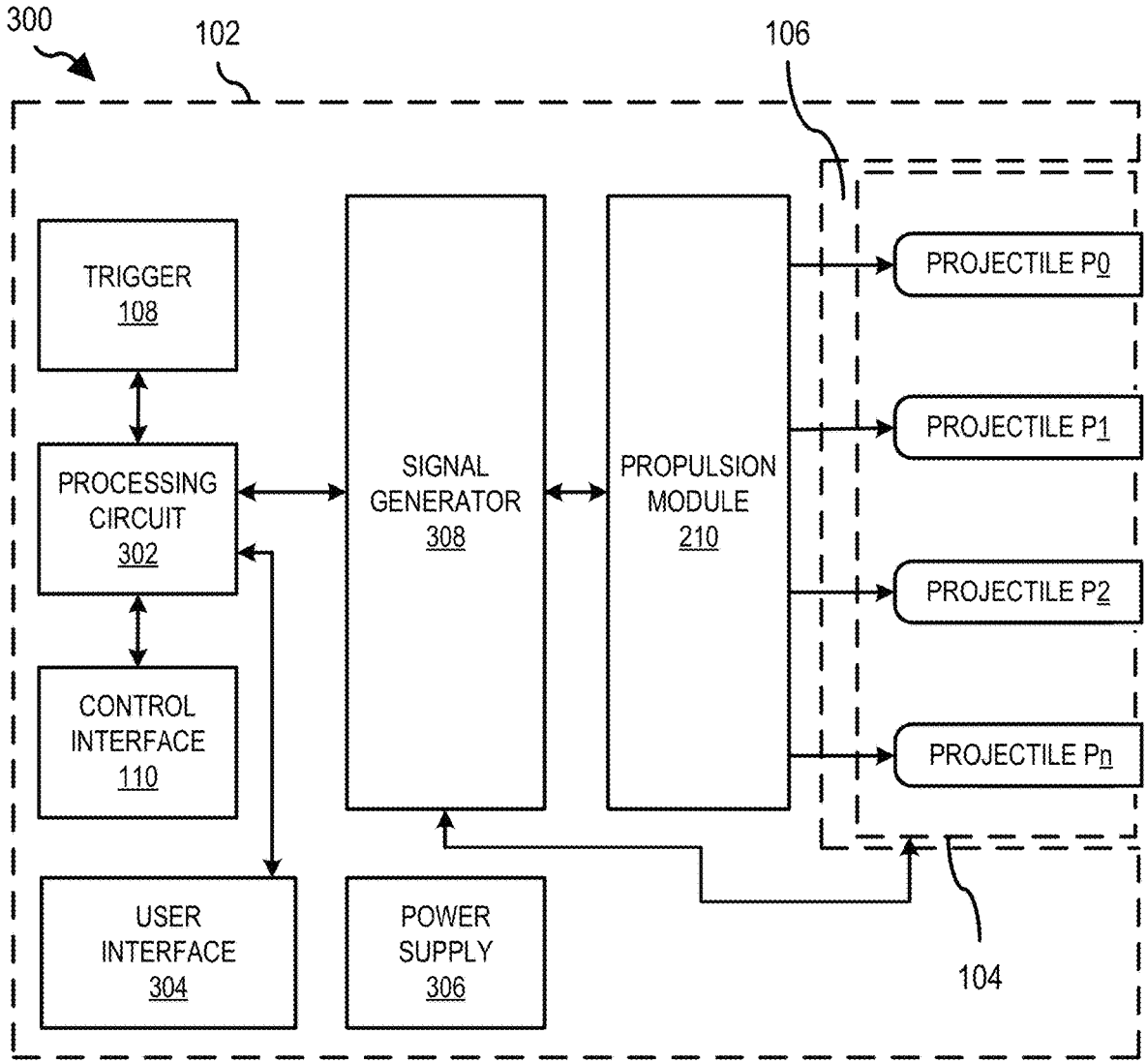
FIG. 3 is a schematic view of a projectile launcher, in accordance with various embodiments.

In various embodiments, and with reference to FIG. 1, a projectile launcher 100 is disclosed. Projectile launcher 100 may be similar to, or have similar aspects and/or components with, any projectile launcher discussed herein. Projectile launcher 100 may comprise a housing 102 and a magazine 104. The housing 102 of projectile launcher 100 may further comprise a magazine receiver 106, a trigger 108, a control interface 110, a handle end 112, and a deployment end 114. It should be understood by one skilled in the art that FIG. 2 is an alternative perspective of the projectile launcher 100 and that FIG. 3 is a schematic representation of projectile launcher 100. It should be further noted that any of the one or more components of projectile launcher 100 may be located in any suitable position within, or external to, housing 102.

Housing 102 may be configured to house various components of projectile launcher 100 that are configured to enable deployment of one or more projectiles P from magazine 104, provide an electrical current to magazine 104, and otherwise aid in the operation of projectile launcher 100, as discussed further herein. Although depicted as a firearm in FIG. 1, housing 102 may comprise any suitable shape and/or size. Housing 102 may comprise a handle end 112 opposite a deployment end 114. A deployment end 114 may be configured, sized, and shaped to receive one or more magazines 104 via a magazine receiver 106. A handle end 112 may be sized and shaped to be held in a hand of a user. For example, a handle end 112 may be shaped as a handle to enable hand-operation of projectile launcher 100 by the user. In various embodiments, a handle end 112 may also comprise contours shaped to fit the hand of a user, for example, an ergonomic grip. A handle end 112 may include a surface coating, such as, for example, a non-slip surface, a grip pad, a rubber texture, and/or the like. As a further example, a handle end 112 may be wrapped in leather, a colored print, and/or any other suitable material, as desired.

In various embodiments, housing 102 may comprise various mechanical, electronic, and/or electrical components configured to aid in performing the functions of projectile launcher 100. For example, housing 102 may comprise one or more triggers 108, control interfaces 110, processing circuits 302, user interfaces 304, power supplies 306, and/or signal generators 308. Housing 102 may include a guard (e.g., trigger guard). A guard may define an opening formed in housing 102. A guard may be located on a center region of housing 102 (e.g., as depicted in FIGS. 1 and 2), and/or in any other suitable location on housing 102. Trigger 108 may be disposed within a guard. A guard may be configured to protect trigger 108 from unintentional physical contact (e.g., an unintentional activation of trigger 108). A guard may partially and/or fully surround trigger 108 within housing 102.

Magazine 104 may comprise and/or be associated with one or more propulsion modules 210 and/or one or more projectiles P. For example, the one or more projectiles P may be received directly in magazine 104. Alternatively, or in addition, the one or more projectiles P may be received indirectly via one or more cartridges that are inserted into magazine 104. Additionally, a magazine 104 may comprise and/or be associated with a single propulsion module 210 configured to deploy a single projectile P (e.g., a cartridge inserted into magazine 104 comprising a projectile P and an associated propulsion module 210). As a further example, a magazine 104 may comprise and/or be associated with a single propulsion module 210 configured to deploy a plurality of projectiles P. As an additional example, a magazine 104 may comprise and/or be associated with a plurality of propulsion modules 210 and a plurality of projectiles P, with each propulsion module 210 configured to deploy one or more projectiles P. In various embodiments, and as depicted in FIG. 2, magazine 104 may be associated with a propulsion module 210 configured to deploy a first projectile P0, a second projectile P1, a third projectile P2, and additional projectile(s) Pn. In additional embodiments, and as depicted in FIG. 3, magazine 104 may be associated with a first propulsion module configured to deploy a first projectile P0, a second propulsion module configured to deploy a second projectile P1, a third propulsion module configured to deploy a third projectile P2, and an additional propulsion module configured to deploy an additional projectile Pn. Each series of propulsion modules and projectiles may be associated with and/or contained in the same and/or separate magazines.

In various embodiments, a magazine receiver 106 of housing 102 may be configured to receive and/or couple with one or more magazine 104. Magazine receiver 106 may include a channel 202 that secures one or more magazine 104 to the magazine receiver 106. Channel 202 may be formed such that a portion 204 of magazine 104 is passively (i.e., one or more static structures that secure magazine 104) and/or actively (i.e., one or more dynamic structures that secure magazine 104 by switching from a first state to a second state) secured to the magazine receiver 106. For example, channel 202 may be shaped to comprise an opening in an end of housing 102 that permits a portion 204 of magazine 104 to be inserted into channel 202. Alternatively, or in addition, channel 202 may comprise one or more flanges, rails, ridges, or raised components that guide and/or secure portion 204 of magazine 104 within channel 202. In further examples, channel 202 may include one or more components that are engaged based at least in part on magazine 104 being inserted within magazine receiver 106 to actively secure magazine 104. Generally, channel 202 and/or magazine receiver 106 may comprise one or more mechanical features configured to removably couple one or more magazines 104 within the magazine receiver 106. The magazine receiver 106, and the channel 202, may be configured to receive a single magazine, two magazines, three magazines, nine magazines, or any other number of magazines.

In various embodiments, a magazine receiver 106 of housing 102 may be configured as a bay that receives one or more magazine 104. The bay may comprise an opening in an end of housing 102 sized and shaped to receive one or more magazine 104. The bay may include one or more mechanical features configured to removably couple one or more magazine 104 within the bay. The bay of housing 102 may be configured to receive a single cartridge, two cartridges, three cartridges, nine cartridges, or any other number of cartridges.

In various embodiments, magazine 104 may comprise a magazine interface 206 that is configured to couple with a housing interface 208 associated with housing 102. Magazine interface 206 and housing interface 208 may be configured to communicate signals, indicators, electrical currents, propellants, and information between magazine 104 and housing 102. For example, inserting magazine 104 into magazine receiver 106 may enable launching of one or more projectiles P by processing circuit 302. Additionally, magazine interface 206 and housing interface 208 may comprise one or more devices, sockets, plugs, connectors, nozzles, and other coupling components that enable the communication of signals, substances, and/or information.

In various embodiments, magazine 104 may comprise a plurality of magazine interfaces 206 and a plurality of housing interfaces 208 associated with housing 102. Individual magazine interfaces and individual housing interfaces may be configured to communicate at least one of signals, electrical currents, propellants, and information between magazine 104 and housing 102. For example, inserting magazine 104 into magazine receiver 106 may enable launching one or more projectiles P by processing circuit 302. The plurality of magazine interfaces 206 and the plurality of housing interfaces 208 may couple when magazine 104 is inserted into housing 102, forming one or more communication pathways that enable one or more projectiles P to be launched by control circuit 302.

Magazine 104 may comprise one or more propulsion modules 210 and one or more projectiles P. For example, a magazine 104 may comprise and/or be associated with a single propulsion module 210 configured to deploy a single projectile P. As a further example, a magazine 104 may comprise and/or be associated with a single propulsion module 210 configured to deploy a plurality of projectiles P. As a further example, a magazine 104 may comprise and/or be associated with a plurality of propulsion modules 210 and a plurality of projectiles P, with each propulsion module 210 configured to deploy one or more projectiles P. In various embodiments, and as depicted in FIGS. 2 and 3, magazine 104 may be associated with propulsion module 210 configured to deploy a first projectile P0, a second projectile P1, a third projectile P2, and one or more additional projectiles Pn. Alternatively, propulsion module 210 may comprise a plurality of submodules such that a first propulsion submodule is configured to deploy the first projectile P0, a second propulsion submodule is configured to deploy the second projectile P1, a third propulsion submodule is configured to deploy the third projectile P2, and one or more additional propulsion submodules are configured to deploy the one or more addition projectiles Pn. Each series of propulsion modules and projectiles may be associated with and/or contained in the same and/or separate magazines.

In various embodiments, a propulsion module 210 may be coupled to, or in communication with one or more magazine 104. In particular, propulsion module 210 may be coupled to, or in communication with magazine 104 such that one or more projectiles P within magazine 104 may be launched, propelled, and/or otherwise driven towards a target. A propulsion module 210 may comprise any device, propellant (e.g., air, gas, etc.), primer, or the like capable of providing a propulsion force in magazine 104 and/or to one or more projectiles P. The propulsion force may include an increase in pressure caused by rapidly expanding gas within an area or chamber. The propulsion force may be directed from the propulsion module to one or more projectiles P in magazine 104 to cause the deployment of the one or more projectiles P. For example, housing 102 and magazine 104 may be in communication via magazine interface 206 and housing interface 208. Magazine interface 206 and housing interface 208 may be configured to form a connection that provides propulsion force from a propulsion module 210 associated with the housing 102 to one or more projectiles P associated with magazine 104. The propulsion force may be directed the propulsion module 210, via the connection formed between magazine interface 206 and housing interface 208, to cause the deployment of the one or more projectiles P.

In various embodiments, a propulsion module 210 may be coupled to, or in communication with one or more projectiles P in magazine 104. In various embodiments, magazine 104 may comprise a plurality of propulsion modules 210, with each propulsion module 210 coupled to, or in communication with, one or more projectiles P. As noted above, propulsion module 210 may provide a propulsion force in magazine 104. The propulsion force may include an increase in pressure caused by rapidly expanding gas within an area or chamber that causes deployment of the one or more projectiles P. Similar to examples discussed above, the propulsion force may be directed from the plurality of propulsion modules 210 to one or more projectiles P via one or more connections formed by magazine interface 206 and housing interface 208.

In various embodiments, the propulsion force may be directly applied to one or more projectiles P. For example, a propulsion force from propulsion module 210 may be provided directly to first projectile P0. A propulsion module 210 may be in fluid communication with one or more projectiles to provide the propulsion force. For example, a propulsion force from propulsion module 210 may travel within a fluid channel associated with housing 102 and magazine 104 to first projectile P0. The propulsion force may travel via a manifold in housing 102 and/or magazine 104.

In various embodiments, the propulsion force may be provided indirectly to one or more projectiles P. For example, the propulsion force may be provided to a secondary source of propellant within propulsion module 210. The propulsion force may launch the secondary source of propellant within propulsion module 210, causing the secondary source of propellant to release propellant. A force associated with the released propellant may in turn provide a force to one or more projectiles P. A force generated by a secondary source of propellant may cause the one or more projectiles P to be deployed from the magazine 104 and projectile launcher 100.

In various embodiments, each projectile P0, P1, P2, . . . , and Pn may each be configured to provide a payload to a target. For example, a payload associated with one or more projectiles P may be or include an electrode (e.g., an electrode dart), an entangling projectile (e.g., a tether-based entangling projectile, a net, etc.), a solid substance, a liquid substance, gas substance, or the like. A projectile P may include a spear portion, designed to pierce or attach proximate a tissue of a target in order to provide a conductive electrical path between the electrode and the tissue, as previously discussed herein.

In various embodiments, trigger 108 (e.g., projectile launcher trigger, handle trigger, etc.) may be coupled to an outer surface of housing 102, and may be configured to move, slide, rotate, or otherwise become physically depressed or moved upon application of physical contact. For example, trigger 108 may be actuated by physical contact applied to trigger 108 from within a guard. Trigger 108 may comprise a mechanical or electromechanical switch, button, trigger, or the like. For example, trigger 108 may comprise a switch, a pushbutton, and/or any other suitable type of trigger. Trigger 108 may be mechanically and/or electronically coupled to processing circuit 302. In response to trigger 108 being activated (e.g., depressed, pushed, etc. by the user), processing circuit 302 may enable deployment of (or cause deployment of) one or more projectiles P from magazine 104 of projectile launcher 100, as discussed further herein.

Control interface 110 (e.g., projectile launcher control interface, handle control interface, etc.) of projectile launcher 100 may comprise, or be similar to, any control interface disclosed herein. In various embodiments, control interface 110 may be configured to control selection of firing modes in projectile launcher 100. Controlling selection of firing modes in projectile launcher 100 may include disabling firing of projectile launcher 100 (e.g., a safety mode, etc.), enabling firing of projectile launcher 100 (e.g., an active mode, a firing mode, an escalation mode, etc.), controlling deployment of one or more projectiles P from magazine 104, and/or similar operations, as discussed further herein. In various embodiments, control interface 110 may also be configured to perform (or cause performance of) one or more operations that do not include the selection of firing modes. For example, control interface 110 may be configured to enable the selection of operating modes of projectile launcher 100, selection of options within an operating mode of projectile launcher 100, or similar selection or scrolling operations, as discussed further herein.

Control interface 110 may be located in any suitable location on or in housing 102. For example, control interface 110 may be coupled to an outer surface of housing 102. Control interface 110 may be coupled to an outer surface of housing 102, proximate to trigger 108, and/or a guard of housing 102. Control interface 110 may be electrically, mechanically, and/or electronically coupled to processing circuit 302. In various embodiments, in response to control interface 110 comprising electronic properties or components, control interface 110 may be electrically coupled to power supply 306. Control interface 110 may receive power (e.g., electrical current) from power supply 306 to power the electronic properties or components.

Control interface 110 may be electronically or mechanically coupled to trigger 108. For example, and as discussed further herein, control interface 110 may function as a safety mechanism. In response to control interface 110 being set to a "safety mode," projectile launcher 100 may be unable to launch projectile(s) P from magazine 104. For example, control interface 110 may provide a signal (e.g., a control signal) to processing circuit 302 instructing processing circuit 302 to disable deployment of projectile(s) P from magazine 104. As a further example, control interface 110 may electronically or mechanically prohibit trigger 108 from activating (e.g., prevent or disable a user from depressing trigger 108; prevent trigger 108 from launching a projectile(s) P; etc.).

Control interface 110 may comprise any suitable electronic or mechanical component capable of enabling selection of firing modes. For example, control interface 110 may comprise a fire mode selector switch, a safety switch, a safety catch, a rotating switch, a selection switch, a selective firing mechanism, and/or any other suitable mechanical control. As a further example, control interface 110 may comprise a slide, such as a handgun slide, a reciprocating slide, or the like. As a further example, control interface 110 may comprise a touch screen, user interface or display, or similar electronic visual component.

The safety mode may be configured to prohibit deployment of a projectile P from magazine 104 in projectile launcher 100. For example, in response to a user selecting the safety mode, control interface 110 may transmit a safety mode instruction to processing circuit 302. In response to receiving the safety mode instruction, processing circuit 302 may prohibit deployment of a projectile P from magazine 104. Processing circuit 302 may prohibit deployment until a further instruction is received from control interface 110 (e.g., a firing mode instruction). As previously discussed, control interface 110 may also, or alternatively, interact with trigger 108 to prevent activation of trigger 108. In various embodiments, the safety mode may also be configured to prohibit deployment of a stimulus signal from signal generator 308, such as, for example, a local delivery.

The firing mode may be configured to enable deployment of one or more projectiles P from magazine 104 in projectile launcher 100. For example, and in accordance with various embodiments, in response to a user selecting the firing mode, control interface 110 may transmit a firing mode instruction to processing circuit 302. In response to receiving the firing mode instruction, processing circuit 302 may enable deployment of a projectile P from magazine 104 by propulsion module 210. In that regard, in response to trigger 108 being activated, processing circuit 302 may cause the deployment of one or more projectiles P. Processing circuit 302 may enable deployment until a further instruction is received from control interface 110 (e.g., a safety mode instruction). As a further example, and in accordance with various embodiments, in response to a user selecting the firing mode, control interface 110 may also mechanically (or electronically) interact with trigger 108 of projectile launcher 100 to enable activation of trigger 108.

In various embodiments, processing circuit 302 may comprise any circuitry, electrical components, electronic components, software, and/or the like configured to perform various operations and functions discussed herein. For example, processing circuit 302 may comprise a processing circuit, a processor, a digital signal processor, a microcontroller, a microprocessor, an application specific integrated circuit (ASIC), a programmable logic device, logic circuitry, state machines, MEMS devices, signal conditioning circuitry, communication circuitry, a computer, a computer-based system, a radio, a network appliance, a data bus, an address bus, and/or any combination thereof. In various embodiments, processing circuit 302 may include passive electronic devices (e.g., resistors, capacitors, inductors, etc.) and/or active electronic devices (e.g., op amps, comparators, analog-to-digital converters, digital-to-analog converters, programmable logic, SRCs, transistors, etc.). In various embodiments, processing circuit 302 may include data buses, output ports, input ports, timers, memory, arithmetic units, and/or the like.

In various embodiments, processing circuit 302 may include signal conditioning circuitry. Signal conditioning circuitry may include level shifters to change (e.g., increase, decrease) the magnitude of a voltage (e.g., of a signal) before receipt by processing circuit 302 or to shift the magnitude of a voltage provided by processing circuit 302.

In various embodiments, processing circuit 302 may be configured to control and/or coordinate operation of some or all aspects of projectile launcher 100. For example, processing circuit 302 may include (or be in communication with) memory configured to store data, programs, and/or instructions. The memory may comprise a tangible non-transitory computer-readable memory. Instructions stored on the tangible non-transitory memory may allow processing circuit 302 to perform various operations, functions, and/or steps, as described herein.

In various embodiments, the memory may comprise any hardware, software, and/or database component capable of storing and maintaining data. For example, a memory unit may comprise a database, data structure, memory component, or the like. A memory unit may comprise any suitable non-transitory memory known in the art, such as, an internal memory (e.g., random access memory (RAM), read-only memory (ROM), solid state drive (SSD), etc.), removable memory (e.g., an SD card, an XD card, a CompactFlash card, etc.), or the like.

Processing circuit 302 may be configured to provide and/or receive electrical signals whether digital and/or analog in form. Processing circuit 302 may provide and/or receive digital information via a data bus using any protocol. Processing circuit 302 may receive information, manipulate the received information, and provide the manipulated information. Processing circuit 302 may store information and retrieve stored information. Information received, stored, and/or manipulated by processing circuit 302 may be used to perform a function, control a function, and/or to perform an operation or execute a stored program.

Processing circuit 302 may control the operation and/or function of other circuits and/or components of projectile launcher 100. Processing circuit 302 may receive status information regarding the operation of other components, perform calculations with respect to the status information, and provide commands (e.g., instructions) to one or more other components. Processing circuit 302 may command another component to start operation, continue operation, alter operation, suspend operation, cease operation, or the like. Commands and/or status may be communicated between processing circuit 302 and other circuits and/or components via any type of bus (e.g., SPI bus) including any type of data/address bus.

In various embodiments, processing circuit 302 may be mechanically and/or electronically coupled to trigger 108. Processing circuit 302 may be configured to detect an activation, actuation, depression, input, etc. (collectively, an "activation event") of trigger 108. In response to detecting the activation event, processing circuit 302 may be configured to perform various operations and/or functions, as discussed further herein. Processing circuit 302 may also include a sensor (e.g., a trigger sensor) attached to trigger 108 and configured to detect an activation event of trigger 108. The sensor may comprise any suitable sensor, such as a mechanical and/or electronic sensor capable of detecting an activation event in trigger 108 and reporting the activation event to processing circuit 302.

In various embodiments, processing circuit 302 may be mechanically and/or electronically coupled to control interface 110. Processing circuit 302 may be configured to detect an activation, actuation, depression, input, etc. (collectively, a "control event") of control interface 110. In response to detecting the control event, processing circuit 302 may be configured to perform various operations and/or functions, as discussed further herein. Processing circuit 302 may also include a sensor (e.g., a control sensor) attached to control interface 110 and configured to detect a control event of control interface 110. The sensor may comprise any suitable mechanical and/or electronic sensor capable of detecting a control event in control interface 110 and reporting the control event to processing circuit 302.

In various embodiments, processing circuit 302 may be electrically and/or electronically coupled to power supply 306. Processing circuit 302 may receive power from power supply 306. The power received from power supply 306 may be used by processing circuit 302 to receive signals, process signals, and transmit signals to various other components in projectile launcher 100. Processing circuit 302 may use power from power supply 306 to detect an activation event of trigger 108, a control event of control interface 110, or the like, and generate one or more control signals in response to the detected events. The control signal may be based on the control event and the activation event. The control signal may be an electrical signal.

In various embodiments, power supply 306 may be configured to provide power to various components of projectile launcher 100. For example, power supply 306 may provide energy for operating the electronic and/or electrical components (e.g., parts, subsystems, circuits, etc.) of projectile launcher 100 and/or one or more magazine 104. Power supply 306 may provide electrical power. Providing electrical power may include providing a current at a voltage. Power supply 306 may be electrically coupled to processing circuit 302 and/or signal generator 308. In various embodiments, in response to a control interface comprising electronic properties and/or components, power supply 306 may be electrically coupled to the control interface 110. In various embodiments, in response to trigger 108 comprising electronic properties or components, power supply 306 may be electrically coupled to trigger 108. Power supply 306 may provide an electrical current at a voltage. Electrical power from power supply 306 may be provided as a direct current ("DC"). Electrical power from power supply 306 may be provided as an alternating current ("AC"). Power supply 306 may include a battery. The energy of power supply 306 may be renewable or exhaustible, and/or replaceable. For example, power supply 306 may comprise one or more rechargeable or disposable batteries. In various embodiments, the energy from power supply 306 may be converted from one form (e.g., electrical, magnetic, thermal) to another form to perform the functions of a system.

Power supply 306 may provide energy for performing the functions of projectile launcher 100. For example, and when projectile launcher 100 is configured to perform operations of a CEW, power supply 306 may provide the electrical current to signal generator 308 that is provided through a target to impede locomotion of the target (e.g., via magazine 104). Power supply 306 may provide the energy for a stimulus signal. Power supply 306 may provide the energy for other signals, including an ignition signal, as discussed further herein.

In various embodiments, processing circuit 302 may be electrically and/or electronically coupled to signal generator 308. Processing circuit 302 may be configured to transmit or provide control signals to signal generator 308 in response to detecting an activation event of trigger 108. Multiple control signals may be provided from processing circuit 302 to signal generator 308 in series. In response to receiving the control signal, signal generator 308 may be configured to perform various functions and/or operations, as discussed further herein.

In various embodiments, signal generator 308 may be configured to receive one or more control signals from processing circuit 302. Signal generator 308 may provide an ignition signal to magazine 104 and/or propulsion module 210 based on the control signals. Signal generator 308 may be electrically and/or electronically coupled to processing circuit 302, propulsion module 210, and/or magazine 104. Signal generator 308 may be electrically coupled to power supply 306. Signal generator 308 may use power received from power supply 306 to generate an ignition signal. For example, signal generator 308 may receive an electrical signal from power supply 306 that has first current and voltage values. Signal generator 308 may transform the electrical signal into an ignition signal having second current and voltage values. The transformed second current and/or the transformed second voltage values may be different from the first current and/or voltage values. The transformed second current and/or the transformed second voltage values may be the same as the first current and/or voltage values. Signal generator 308 may temporarily store power from power supply 306 and rely on the stored power entirely or in part to provide the ignition signal. Signal generator 308 may also rely on received power from power supply 306 entirely or in part to provide the ignition signal, without needing to temporarily store power.

Signal generator 308 may be controlled entirely or in part by processing circuit 302. In various embodiments, signal generator 308 and processing circuit 302 may be separate components (e.g., physically distinct and/or logically discrete). Signal generator 308 and processing circuit 302 may be a single component. For example, a control circuit within housing 102 may at least include signal generator 308 and processing circuit 302. The control circuit may also include other components and/or arrangements, including those that further integrate corresponding function of these elements into a single component or circuit, as well as those that further separate certain functions into separate components or circuits.

Signal generator 308 may be controlled by the control signals to generate an ignition signal having a predetermined current value or values. For example, signal generator 308 may include a current source. The control signal may be received by signal generator 308 to activate the current source at a current value of the current source. An additional control signal may be received to decrease a current of the current source. For example, signal generator 308 may include a pulse width modification circuit coupled between a current source and an output of the control circuit. A second control signal may be received by signal generator 308 to activate the pulse width modification circuit, thereby decreasing a non-zero period of a signal generated by the current source and an overall current of an ignition signal subsequently output by the control circuit. The pulse width modification circuit may be separate from a circuit of the current source or, alternatively, integrated within a circuit of the current source. Various other forms of signal generators 308 may alternatively or additionally be employed, including those that apply a voltage over one or more different resistances to generate signals with different currents. In various embodiments, signal generator 308 may include a high-voltage module configured to deliver an electrical current having a high voltage. In various embodiments, signal generator 308 may include a low-voltage module configured to deliver an electrical current having a lower voltage, such as, for example, 2,000 volts.

Responsive to receipt of a signal indicating activation of trigger 108 (e.g., an activation event, an activation signal, etc.), processing circuit 302 may provide an ignition signal to magazine 104, a projectile P in magazine 104, and/or a propulsion module 210 associated with magazine 104. For example, signal generator 308 may provide an electrical signal as an ignition signal to magazine 104 in response to receiving a control signal from processing circuit 302. In various embodiments, the ignition signal may be separate and distinct from a stimulus signal. For example, a stimulus signal in projectile launcher 100 may be provided to a different circuit within magazine 104, relative to a circuit to which an ignition signal is provided. Signal generator 308 may be configured to generate a stimulus signal. In various embodiments, a second, separate signal generator, component, or circuit (not shown) within housing 102 may be configured to generate the stimulus signal. Signal generator 308 may also provide a ground signal path for magazine 104, thereby completing a circuit for an electrical signal provided to magazine 104 by signal generator 308. The ground signal path may also be provided to magazine 104 by other elements in housing 102, including power supply 306.

In various embodiments, projectile launcher 100 may deliver a stimulus signal via a circuit that includes signal generator 308 positioned in the handle and/or handle end 112 of projectile launcher 100. An interface (e.g., cartridge interface, magazine interface 206, etc.) mounted on and/or associated with each magazine 104 inserted into housing 102 and/or magazine receiver 106 electrically couples to an interface (e.g., handle interface, housing interface 208, etc.) in the handle of housing 102. Signal generator 308 couples to each magazine 104, and thus to electrodes associated with one or more projectiles P, via the handle interface 208 and the magazine interface 206. A first filament may couple to magazine interface 206 and to a first electrode associated with a first projectile P0. A second filament couples to the magazine interface 206 and to a second electrode associated with a second projectile P1. The stimulus signal travels from signal generator 308, through the first filament and the first electrode, through target tissue, and through the second electrode and second filament back to signal generator 308.

In various embodiments, projectile launcher 100 may further comprise one or more user interfaces 304. A user interface 304 may be configured to receive an input from a user of projectile launcher 100 and/or transmit an output to the user of projectile launcher 100. User interface 304 may be located in any suitable location on or in housing 102. For example, user interface 304 may be coupled to an outer surface of housing 102 or extend at least partially through the outer surface of housing 102. User interface 304 may be electrically, mechanically, and/or electronically coupled to processing circuit 302. In various embodiments, in response to user interface 304 comprising electronic or electrical properties or components, user interface 304 may be electrically coupled to power supply 306. User interface 304 may receive power (e.g., electrical current) from power supply 308 to power the electronic properties or components.

In various embodiments, user interface 304 may comprise one or more components configured to receive an input from a user. For example, user interface 304 may comprise one or more of an audio capturing module (e.g., microphone) configured to receive an audio input, a visual display (e.g., touchscreen, LCD, LED, etc.) configured to receive a manual input, a mechanical interface (e.g., button, switch, etc.) configured to receive a manual input, and/or the like. In various embodiments, user interface 304 may comprise one or more components configured to transmit or produce an output. For example, user interface 304 may comprise one or more of an audio output module (e.g., audio speaker) configured to output audio, a light-emitting component (e.g., flashlight, laser guide, etc.) configured to output light, a visual display (e.g., touchscreen, LCD, LED, etc.) configured to output a visual, and/or the like.

Figure 4:
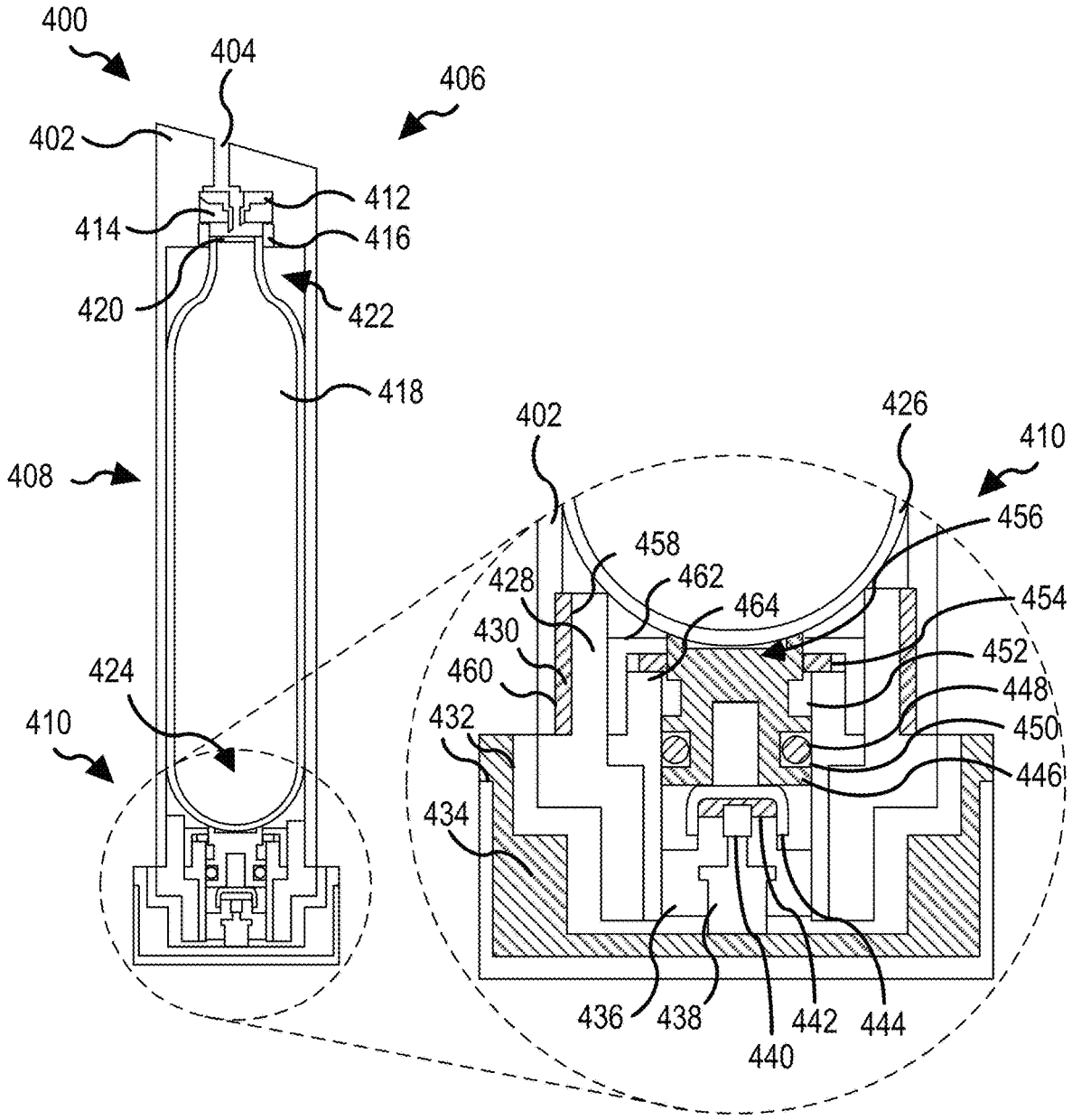
FIG. 4 is a cross section view of a propulsion module for a projectile launcher in a first state, in accordance with various embodiments.

In various embodiments, and with reference to FIG. 4, projectile launcher 100 may comprise propulsion module 400. Propulsion module 400 may be similar to, or have similar aspects and/or components with, any propulsion module discussed herein (e.g., propulsion module 210). Propulsion module housing 402 of propulsion module 400 may comprise fluid channel 404, a first portion 406, a second portion 408, and a third portion 410. The first portion 406 of the propulsion module housing 402 may comprise needle 412 (e.g., a puncture structure, a coupling structure, a breaching structure, etc.), head seal 414, and cannister collar 416. Additionally, propulsion module 400 may further comprise propellant cannister 418 defined by at least propellant cannister wall 426 and propellant seal 420. Propellant cannister 418 may further contain an amount of propellant that is stored at a storage temperature and a storage pressure. It should be further noted that any of the one or more components of propulsion module 400 may be located in any suitable position within, or external to, housing 102.

In various embodiments, propulsion module housing 402 may be configured as a component and/or a portion of housing 102. Propulsion module housing 402 may be configured as a removable portion of the housing 102 that contains one or more fluid channels, valves, regulators, and/or other components that provide propellant for launching one or more projectiles P from magazine 104. Alternatively, or in addition, propulsion module housing 402 may be configured as an integrated portion of housing 102 that contains one or more fluid channels valves, regulators, and/or other components that provide propellant for launching one or more projectiles P. In some examples, propulsion module housing 402 may be formed to contain, support, protect, secure, and/or encase components of the propulsion module 400. Additionally, propulsion module housing 402 may be comprised of at least a first portion 406, a second portion 408, and/or a third portion 410.

Propulsion module housing 402 may be configured as a fluidly sealed container upon installation of propellant cannister 418, third portion 410, and/or other components of propulsion module 400. A cannister neck 422 may be configured to fit within, couple with, and/or otherwise connect to the cannister collar 416 upon installation within the propulsion module housing 402. Alternatively, or in addition, propulsion module housing 402 may be configured as a physical container (e.g., permeable to some or all fluids) that secures and protects components of propulsion module 400. Propulsion module housing 402 may be configured to enable fluid communication between a propellant source (e.g., propellant cannister 418) and housing 102 via at least fluid channel 404. Propulsion module housing 402, and other structural components described herein, may be formed from one or more metallic, plastic, polymeric, composite, organic, and/or other materials. It should be noted that propulsion module housing 402 may take on a variety of shapes, sizes, profiles, and/or physical dimensions depending on at least the projectile launcher associated with the propulsion system 400, the volume of propellant contained by the propellant cannister 418, accessory systems associated with the propulsion module housing (e.g., ejection system for propulsion module 400, ejection system for propellant cannister 418, pressure regulating systems, propulsion module monitoring systems, etc.). Accordingly, while propulsion module housing 402 is depicted as a substantially rectangular prism, propulsion module housing 402 may be configured in various three-dimensional shapes selected based at least on the internal components of propulsion module 400 and systems of the associated projectile launcher.

In various embodiments, propulsion module housing 402 may be configured as a single integrated structure or as a series of coupled structures. For example, and as illustrated by FIG. 4, propulsion module housing 402 may be configured as a single structure having first portion 406, second portion 408, and third portion 410 containing various components of propulsion module 400. Alternatively, or in addition, propulsion module housing 402 may be comprised of separate and connected subassemblies (e.g., third portion 410 is removable from first portion 406 and second portion 408, second portion 408 is removable from first portion 406, etc.) containing the various components of propulsion module 400.

Fluid channel 404 may be a component associated with propulsion module housing 402 that forms at least a portion of a fluid communication path between propulsion module 400 and housing 102 of a projectile launcher 100. For example, fluid channel 404 may be configured as a fluid communication path that directs an amount of propellant received from propellant cannister 418, through housing 102, and to one or more projectiles P within magazine 104, the amount of propellant applying a propulsion force that launches one or more projectiles P from magazine 104. Alternatively, or in addition, fluid channel 404 may be configured as a fluid communication path that provides the amount of propellant received from propellant cannister 418 to an internal component of housing 102 and/or magazine 104. In various embodiments, fluid channel 404 may be configured as a static component and/or a dynamic component that comprises one or more valves, pressure regulators, flow regulators, and/or other subcomponents. Static components may refer to components that do not substantially change state and/or alter shape during utilization or when switching between being utilized and not being utilized. Dynamic components may refer to components that change state and/or alter shape during utilization or when switching between being utilized and not being utilized.

Fluid channel 404 may extend between and/or form a fluid communication path for needle 412 and projectile launcher 100. Fluid channel 404 may comprise a variable inner diameter or a consistent inner diameter along the fluid communication path. Additionally, fluid channel 404 may be configured such that fluid channel 404 and needle 412 share a central axis, a first axis of fluid channel 404 is parallel to a second axis of needle 412, the first axis of fluid channel 404 is aligned to an axial plane of needle 412 (e.g., fluid channel 404 is perpendicular to needle 412), and/or the first axis of fluid channel 404 is unaligned relative to the second axis of needle 412 (e.g., fluid channel 404 connects to a chamber that further connects to needle 412). Further, fluid channel 404 may be configured such that propellant stored by propellant cannister 418 may be provided to projectile launcher 100 at a pressure exceeding a pressure threshold and/or a flow rate exceeding a flow rate threshold. For example, the pressure threshold and/or the flow rate threshold may be determined to enable one or more projectiles P to be launched from projectile launcher 100. Alternatively, or in addition, the pressure threshold and/or the flow rate threshold may be determined based at least on a minimum input pressure and/or a minimum input flow rate associated with an internal component of projectile launcher 100.

First portion 406 of propulsion housing 402 may be configured to fit within, couple with, be inserted, and/or otherwise be associated with housing 102 of projectile launcher 100. For example, first portion 406 may be configured to couple with a handle end 112 of housing 102 via insertion into a handle recess. First portion 406 may be shaped and/or sized such that fluid channel 404 is aligned with and/or coupled to internal components, additional fluid channels, and/or other propellant systems associated with projectile launcher 100. Additionally, first portion 406 may be configured to contain and/or secure needle 412, head seal 414, cannister collar 416, a propellant seal 420, a neck portion of propellant cannister 418, and other components of propulsion module 400. First portion 406 may comprise one or more recesses shaped and sized to receive and/or secure at least needle 412, head seal 414, and cannister collar 416.

Second portion 408 of the propulsion housing 402 may be configured to fit within, couple with, be inserted, extend from, and/or otherwise be associated with housing 102 of projectile launcher 100. Second portion 408 may be configured to define a recess sized and shaped to receive and/or secure propellant cannister 418. For example, second portion 408 may be sized and shaped such that propellant cannister 418 is substantially contained within second portion 408 to prevent misalignment of cannister neck 422 with cannister collar 416. Alternatively, or in addition, second portion 408 may be sized and/or shaped to align propellant cannister 418 with needle 412 and puncher 424. Further, second portion 408 may be configured to guide propellant cannister 418 between a first position and a second position. For example, the first position may be associated with propellant cannister 418 being spaced from needle 412 and head seal 414 such that propellant cannister 418 is fluidly isolated from fluid channel 404. The second position may be associated with propellant cannister 418 being adjacent to head seal 414 and in fluid communication with fluid channel 404 via needle 412.

Third portion 410 of the propulsion housing 402 may be configured to fit within, fit partially within, couple with, extend from, and/or otherwise be associated with housing 102 of projectile launcher 100. Third portion 410 may be configured to receive and/or couple with puncher 424 and/or a propulsion module cap associated with puncher 424. For example, third portion 410 may secure puncher 424 adjacent to propellant cannister 418 such that puncher 424 may translate propellant cannister 418 between a first position and a second position. Third portion 410 may comprise threading for receiving screws, bolts, screw caps, and/or other rotational coupling structures. Alternatively, or in addition, third portion 410 may comprise raised flanges, ridges, and/or other structures configured to couple with compatible structures associated with the puncher 424.

First portion 406 and second portion 408 of propulsion module housing 402 may be rigidly coupled. Second portion 408 and third portion 410 of propulsion module housing 402 may be rigidly coupled. A first or upper end of first portion 406 may be coupled with projectile launcher 100. A second or lower end of first portion 406 may be coupled to a first or upper end of second portion 408. A second or lower end of second portion 408 may be coupled to a first or upper end of third portion 410. The first or upper end of first portion 406 may be opposite the second or lower end of first portion 406. The first or upper end of second portion 408 may be opposite the second or lower end of second portion 408. The first or upper end of third portion 410 may be opposite the second or lower end of third portion 410.

Needle 412 may be fluidly connected to fluid channel 404 and coupled to propulsion module housing 402. For example, needle 412 may be affixed to propulsion module housing 402 and fluidly connect propellant cannister 418 and fluid channel 404 such that propellant from propellant cannister 418 may be provided via fluid channel 404. Needle 412 may be configured as a rupturing component (i.e., needle 412 may be configured to break, rupture, and/or otherwise breach propellant seal 420 to form a fluid connection between the propellant cannister 418 and the fluid channel 404) and/or puncturing component (i.e., needle 412 may be configured to pierce, puncture, and/or extend through propellant seal 420 to create a fluid communication path between propellant cannister 418 and fluid channel 404) configured to breach propellant seal 420 and form a fluid pathway between propellant cannister 418 and fluid channel 404. Alternatively, or in addition, needle 412 may be configured as a coupling component compatible with propellant seal 420. Needle 412 and propellant seal 420 may form a fluid pathway between propellant cannister 418 and fluid channel 404 during translation of propellant cannister 418 from a first position to a second position. As propellant cannister 418 translates the first position to the second position, propellant seal 420 may contact a pointed portion of needle 412 that pierces propellant seal 420 and extend into an internal volume of propellant cannister 418 containing an amount of propellant. In various examples, needle 412 may be configured as a static component that fluidly couples with the propellant cannister 418 based at least in part on the propellant cannister 418 translating onto needle 412.

Figure 5:
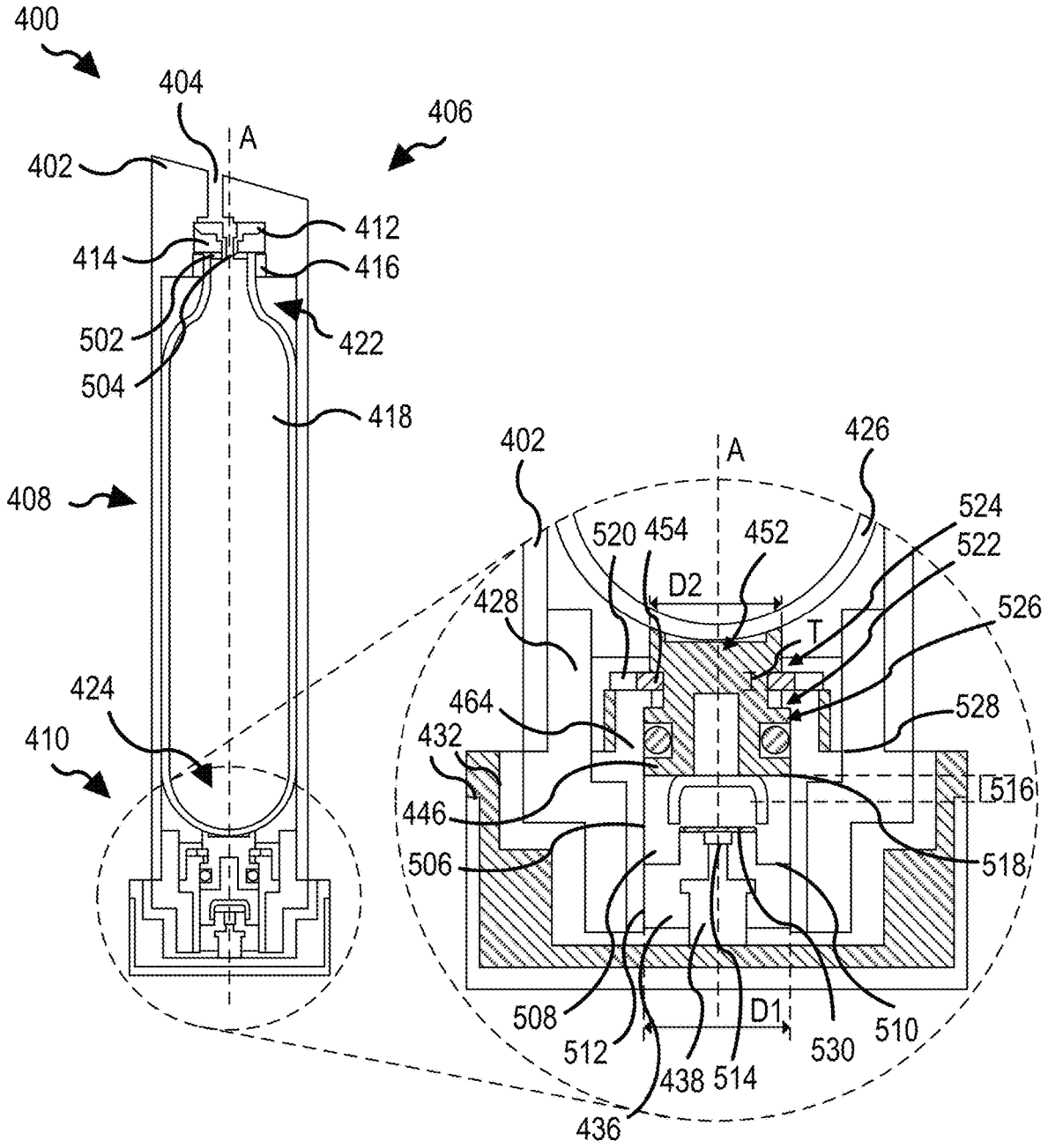
FIG. 5 is a cross section view of a propulsion module for a projectile launcher in a second state, in accordance with various embodiments.

Head seal 414 and cannister collar 416 may be configured to receive cannister neck 422 of the propellant cannister 418 and the propellant seal 420. Head seal 414 may be configured as a stop (i.e., a first component that contacts a second component to restrict, prevent, slow, and/or otherwise contain movement of the second component) for propellant cannister 418 that substantially prevents propellant cannister 418 from contacting and/or damaging other components of propulsion module 400. Head seal 414 may comprise a sealing surface that is spaced from propellant cannister 418 in a first position (as depicted by FIG. 4) and in contact with a portion of propellant cannister 418 in a second position (as depicted by FIG. 5). A distance that head seal 414 is spaced from propellant cannister 418 may be referred to as a travel distance for propellant cannister 418. Further, head seal 414 may be formed from a material capable of creating a fluid seal with the propellant cannister 418 in the second position. Cannister collar 416 may be disposed adjacent to head seal 414 to maintain alignment between propellant cannister 418 and needle 412. Cannister collar 416 may be formed to receive cannister neck 422 of propellant cannister 418 and permit propellant cannister to translate between the first position and the second position.

Propellant cannister 418 may be configured as a container, cannister, bottle, and/or other chamber that contains an amount of propellant (e.g., fluid capable of providing a propulsion force to one or more projectiles P) at an initial pressure. In various examples, propellant cannister 418 may be inserted into and removed from propulsion module housing 402. Additionally, propellant cannister 418 may be translated within propulsion module housing 402 between at least a first position and a second position (e.g., FIG. 4 depicts propellant cannister 418 in a first position where propellant cannister 418 is not in fluid communication with fluid channel 404 and needle 412). It should be noted that while FIG. 4 depicts propellant cannister 418 as a cylindrical object with a first end configured as a sealed neck and a second end configured as a semi-sphere, propellant cannister 418 may be formed as any three-dimensional shape capable of containing an amount of propellant and being breached by needle 412 to form a fluid communication path with housing 102 and/or magazine 104 via fluid channel 404. In various additional examples, propellant cannister 418 may be configured as a disposable cannister that may be discarded, recycled, and/or otherwise disposed after the amount of propellant is utilized by projectile launcher 100. Alternatively, propellant cannister 418 may be configured as a reusable cannister that may be resealed and refilled with propellant after the amount of propellant is utilized by projectile launcher 100.

Puncher 424 may be configured as a puncher (i.e., a device configured to apply a high-pressure impetus to at least a surface), a single-use piston, a multi-use piston, an actuator, a press, and/or a device capable of applying a drive force to propellant cannister 418 in response to at least an activation signal. Puncher 424 may be comprised of one or more subassemblies that combine and/or are coupled to provide the overall functionality of puncher 424. Alternatively, puncher 424 may be an integrated assembly of components that couples with propulsion module housing 402. Puncher 424 may be in contact with a propellant cannister wall 426 such that a driving force may be provided by the puncher to the propellant cannister 418 within the propulsion module housing 402.

Puncher 424 (e.g., piston 424, actuator 424, motor 424, etc.) may comprise a puncher casing 428 (e.g., puncher housing 428, piston casing 428, piston housing 428, channel wall 428, etc.) configured to couple with propulsion module housing 402 via propulsion housing interface 430. Puncher casing 428 may be further configured to couple and/or be combined with propulsion module cap 432 containing conductive plate 434. Additionally, puncher casing 428 may define a puncher channel that contains a primer wall 436, a primer ignition plate 438, a primer contact 440, a primer charge 442, and/or a primer cap 444. The puncher channel may further contain puncher head 446, puncher seal 448 within a first recess 450, a second recess 452, locking ring 454, and/or puncher cup 456. Puncher 424 may be configured in a first state that is associated with a first time and a first position of the propellant cannister 418. The first state of puncher 424 may be referred to as an unprimed state, an unpressured state, a safety state, an inactive state, an initial state, and/or other state that is associated with the propulsion module 400 being substantially inactive and/or substantially prevented from providing propellant to the projectile launcher 100 to launcher one or more projectiles P. The first state of puncher 424 may be further associated with the propellant seal 420 of propellant cannister 418 isolating the amount of propellant within the propellant cannister 418.

Puncher casing 428 may be configured to couple with propulsion module housing 402. Additionally, puncher casing 428 may be configured to define a puncher channel that contains one or more internal components of puncher 424. Further, puncher casing 428 may be configured to couple with propulsion module housing 402 and/or propulsion module cap 432. In some examples, puncher casing 428 may be configured as a cylinder having an internal wall associated with an inner diameter and an external wall associated with an outer diameter. Alternatively, or in addition, puncher casing 428 may be configured as other three-dimensional shapes having an internal wall that defines a puncher channel and an external wall. For example, puncher casing 428 may be configured as a hollow cylinder, where the internal wall of puncher casing 428 substantially defines the puncher channel and provides support (e.g., structural support, positional support, etc.) for one or more internal components of puncher 424. Additionally, the external wall of puncher casing 428 may comprise a puncher coupling surface 458 configured to couple with propulsion module coupling surface 460. Puncher coupling surface 458 and propulsion module coupling surface 460 may be configured as complimentary screw threads that enable puncher 424 to couple with propulsion module housing 402 and form propulsion housing interface 430. It should be noted that while examples related to FIGS. 4 and 5 primarily refer to propulsion housing interface 430 being a screw coupling between puncher coupling surface 458 and propulsion module coupling surface 460, propulsion housing interface 430 may be a transient and/or permanent coupling of propulsion module housing 402 and puncher 424. Propulsion housing interface 430 may be a friction interface, a spring-lock interface, a slide interface, and/or other interface coupling propulsion module housing 402 and puncher 424.

Puncher casing 428 may be further configured to couple with propulsion module cap 432. For example, puncher casing 428 and propulsion module cap 432 may be permanently coupled through welding, sintering, gluing, adhering, and/or otherwise attaching an internal cap wall with the external wall of puncher casing 428. Alternatively, puncher casing 428 and propulsion module cap 432 may be transiently coupled in a manner similar to propulsion housing interface 430 coupling puncher casing 428 with propulsion module housing 402. Additionally, puncher casing 428 and propulsion module cap 432 may be configured to substantially define an external surface of puncher 424 while puncher 424 is unassociated with the propulsion module housing 402.

Puncher casing 428 may be shaped and sized to enable internal components of puncher 424 to fit within the puncher channel, to fit within the propulsion module cap 432, and/or to couple (in combination with the propulsion module cap 432) with the third portion 410 of the propulsion module housing 402. Individual physical features of puncher casing 428 may be further configured based at least on specific implementations associated with the projectile launcher 100, the propulsion module 400, the propulsion module housing 402, the puncher 424, and/or the propulsion module cap 432.

Propulsion module cap 432 (e.g., piston cap 432, propulsion module cap 432, puncher covering 432, propulsion module covering 432, etc.) may be configured to at least partially enclose puncher 424 in association with the propulsion module housing 402. Additionally, propulsion module cap 432 may be configured to expose a portion of conductive plate 434. For example, propulsion module cap 432 may be comprised of a nonconductive material that substantially encloses conductive plate 434. Propulsion module cap 432 may expose a portion of conductive plate 434 (e.g., a conductive ring, a conductive bar, a contact ring, a contact plate, etc.) at a radially external portion of the propulsion module cap 432. Further, the nonconductive material that substantially encloses conductive plate 424 may be configured as a housing overmold and/or a primer overmold (e.g., a portion of material formed to fit over a housing for ergonomic, utility, and/or other usability purposes).

Propulsion module cap 432 may be sized and shaped such that an external portion and an internal portion of the propulsion module cap 432 are a single piece of nonconductive material, a plurality of nonconductive material pieces in contact, and/or are a plurality of combined nonconductive material pieces. For example, propulsion module cap 432 may be formed from one or more piece of nonconductive material that enclose the conductive plate 434, wherein the conductive plate 434 comprises the conductive ring exposed by the propulsion module cap 432 and a bar of conductive material that extends from the conductive ring to primer contact 440 through propulsion module cap 432. Alternatively, or in addition, propulsion module cap 432 may be comprised of an internal portion and an external portion that are separated by the conductive plate enclosed by the propulsion module cap 432. For example, the internal portion and the external portion of the propulsion module cap 432 may be separated by and fastened to the conductive plate 434.

Puncher casing 428 and propulsion module cap 432 may be configured, independently or in combination, to contain one or more internal components of puncher 424 configured to cause the puncher 424 to transition from a first state (associated with FIG. 4) to a second state (associated with FIG. 5). The one or more internal components that cause the transition may include primer wall 436, primer ignition plate 438, primer contact 440, primer charge 442, and/or primer cap 444.

Primer wall 436 (e.g., activation device wall 436, primer activator wall 436, piston activator wall 436, primer casing 436, puncher drive wall 436, piston drive wall 436, etc.) may be disposed within and/or adjacent to an end of the puncher channel. For example, primer wall 436 may be configured to fit radially within at least puncher casing 428 and secure (potentially in combination with at least puncher casing 428) primer ignition plate 438, primer contact 440, primer charge 442, and primer cap 444 within puncher casing 428. Alternatively, or in addition, primer wall 436 may be disposed adjacent to and/or partially within the puncher channel. Primer wall 436 may be configured as a cylinder, a hollow cylinder, and/or other three-dimension shape that fits within puncher casing 428 and having a central axis.

Primer ignition plate 438 (e.g., primer resistor 438, primer heat source 438, heat element 438, resistive element 438, etc.) may be configured to ignite primer charge 442 in response to an activation signal (e.g., activation event, trigger event, ignition signal, etc.) for propulsion module 400. For example, primer ignition plate 438 may be formed from an electrically resistive material that, when exposed to an electrical current provided by and/or in response to the activation signal, generates thermal energy sufficient to ignite primer charge 442. The activation signal may be received by primer ignition plate 438 via primer contact 440. Additionally, primer ignition plate 438 may extend along a shared central axis of primer wall 436 (i.e., central axis of primer wall 436 may also be a central axis of primer ignition plate 438), parallel to a central axis of primer wall 436, and/or between primer contact 440 and primer charge 442.

Primer contact 440 (e.g., primer activator 440, piston activator 440, drive activator 440, drive contact 440, etc.) may extend from conductive plate 434 to primer ignition plate 438 to form an electrical connection. Primer contact 440 may comprise a first electrical contact associated with conductive plate 434, a second electrical contact associated with primer ignition plate 438, and an internal conductive path connecting the first electrical contact and the second electrical contact. The internal conductive path of primer contact 440 may be associated with a first state and a second state. The first state may enable primer contact 440 to complete the electrical connection and transmit one or more signals (e.g., a pilot signal, a connection signal, an activation signal, etc.) between conductive plate 434 and primer ignition plate 438. The second state may substantially prevent primer contact 440 from transmitting the one or more signals and/or disconnect primer contact 440 from conductive plate 434 and/or primer ignition plate 438. For example, primer contact 440 may include a resistive wire that forms the electrical connection between conductive plate 434 and primer ignition plate 438. The resistive wire may be configured to transmit one or more signals from conductive plate 434 to primer ignition plate 438 and/or other electrical components associated with puncher 424. Additionally, the resistive wire may be formed such that an electrical signal exceeding a current threshold (e.g., a current of sufficient magnitude to cause physical effects) causes the resistive wire to transition from the first state to the second state (e.g., a current exceeding the current threshold causing the resistive wire to melt, deform, and/or otherwise break the electrical connection).

Primer contact 440 may extend from primer ignition plate 438 to primer charge 442 and may form an electrical connection. Primer contact 440 may comprise a first electrical contact associated with primer ignition plate 438, a second electrical contact that forms an electrical connection with propulsion module housing 402, and an internal conductive path contacting primer charge 442 and connecting the first electrical contact with the second electrical contact. The internal conductive path of primer contact 440 may be associated with a first state and a second state. The first state may enable primer contact 440 to complete the electrical connection and transmit one or more signals (e.g., a pilot signal, a connection signal, an activation signal, etc.) between primer ignition plate 438 and propulsion module housing 402 (e.g., via second channel lining 464, puncher housing 428, etc.). The second state may substantially prevent primer contact 440 from transmitting the one or more signals, alter a resistance associated with transmitting the one or more signals, and/or disconnect primer ignition plate 438 from propulsion module housing 402. For example, primer contact 440 may include a resistive wire that contacts primer charge 442 and forms at least a portion of the electrical connection between primer ignition plate 438 and propulsion module housing 402. The resistive wire may be configured to transmit one or more signals from conductive plate 434 to primer ignition plate 438 and/or other electrical components associated with puncher 424. Additionally, the resistive wire may be formed such that an electrical signal exceeding a current threshold (e.g., a current of sufficient magnitude to cause physical effects) causes the resistive wire to transition from the first state to the second state (e.g., a current exceeding the current threshold causing the resistive wire to melt, deform, and/or otherwise break the electrical connection). The resistive wire may extend from primer contact 440 along primer wall 436 to form the electrical connection with propulsion module housing 402.

Primer charge 442 (e.g., puncher charge 442, primer drive source 442, puncher drive source 442, etc.) may be configured as an amount of material capable of detonation, rapid outgassing, expansion, and/or otherwise providing a drive force within the puncher channel of puncher casing 428. Alternatively, primer charge 442 may be configured as a component containing sufficient pressure to provide the drive force. Independent of specific embodiments and implementations, primer charge 442 may be associated with an activation threshold (e.g., a temperature threshold, a force threshold, etc.) that causes the primer charge 442 to provide the drive force within the puncher channel. For example, primer contact 440 may receive and provide an electrical signal that is at least partially converted to thermal energy by primer ignition plate 438. Upon the thermal energy generated by primer ignition plate 438 raising a temperature of the primer charge 442 above the activation threshold, the primer charge 442 may provide the drive force (e.g., the amount of material detonates and causes expanding gases to provide the drive force). In an alternative example, primer ignition plate 438 may be configured as a firing pin that is driven into primer charge 442 at a force exceeding the activation threshold by primer contact 440, wherein primer contact 440 may comprise an electric motor, a compressed spring controlled by a switch, and/or other component that drives primer ignition plate 438 into primer charge 442 upon receiving the activation signal. Independent of the specific embodiment and/or implementation, primer charge 442 may be configured to provide the driving force in response to an activation signal received by primer contact 440.

Primer cap 444 (e.g., protective cover 444, spacer 444, distribution plate 444, puncher drive cap 444, piston drive cap 444, etc.) may be configured to at least partially enclose primer charge 442, protect puncher head 446 from primer charge 442, and/or distribute the drive force generated by primer charge 442 to puncher head 446. Primer cap 444 may be formed from a pressure and/or heat resistant material to prevent deformation of puncher casing 428, the puncher casing, puncher head 446, and/or other components of puncher 424. Additionally, primer cap 444 may be shaped and sized to extend radially external to a portion of primer wall 436. For example, primer cap 444 may be configured to contain a chemical reaction of primer charge 442 and ensure complete combustion of primer charge 442 upon the activation signal being received by the primer contact 440. Alternatively, or in addition, primer cap 444 may be removably disposed adjacent to primer wall 436 and/or primer charge 442 such that the drive force generated by primer charge 442 may cause primer cap 444 to translate puncher head 446 between a first position and a second position.

In various embodiments, a puncher may comprise a puncher head configured to move a propulsion source. The puncher head may translate toward the propulsion source to cause a corresponding movement of the propulsion source. The puncher head may be disposed in the puncher between the propulsion source and a propellant that causes translation of the puncher head toward the propulsion source. For example, puncher 424 may comprise puncher head 446. Puncher head 446 (e.g., piston head 446, puncher body 446, piston body 446, etc.) may be configured to fit radially within the puncher channel and contact a portion of propellant cannister wall 426. Additionally, puncher head 446 may comprise a first recess 450, a second recess 452, and/or a puncher cup 456 formed onto and/or into a cylindrical body of puncher head 446. Further, puncher head 446 may be configured to translate within the puncher channel between at least a first position and a second position. Puncher head 446 may translate from the first position to the second position in response to the drive force generated by primer charge 442. For example, and as depicted by FIG. 4, puncher head 446 may be located in a first position adjacent to, spaced from, and/or in contact with primer cap 444. In response to the primer contact 440 receiving the activation signal, and as depicted by FIG. 5, puncher head 446 may be translated to the second position and may apply the drive force to the propellant cannister 418.

Puncher head 446 may comprise a first recess 450 that contains and/or receives puncher seal 448. Puncher seal 448 may be configured as an o-ring, a ring seal, a sealing surface, a sealing protrusion, and/or other seal that forms a substantially fluid tight seal between puncher casing 428 and puncher head 446. The first recess 450 may be associated with a first end of puncher head 446 proximate to primer charge 442 and/or primer cap 444. The first recess 450 may be configured such that puncher seal 448 is in contact with puncher casing 428, and remains in contact with puncher casing 428, as puncher head 446 translates between the first position and the second position. A portion of the first recess may cause puncher seal 448 to translate puncher head 446 between the first position and the second position. Alternatively, the first recess 450 may be disposed within an internal wall of puncher casing 428 and in contact an external surface of puncher head 446 such that puncher head 446 may translate past puncher seal 448.

In various embodiments, a puncher may comprise a puncher lock configured to selectively limit movement of a puncher head relative to a puncher casing. The puncher lock may comprise a mechanical component. For example, puncher 424 may comprise locking ring 454. The puncher lock may mechanically limit movement of a puncher head. In accordance with mechanically limiting the movement of the puncher head, a relative arrangement of components of a projectile launcher may be maintained by the puncher lock. For example, locking ring 454 may selectively limit movement of puncher head 446 relative to puncher casing 428. In turn, selectively limiting movement of puncher head 446 may further selectively limit movement of propellant seal 420 relative to needle 412, including as further discussed below with regards to FIG. 5.

In various embodiments, a puncher lock may comprise a movable element. The puncher lock may be moved from a first position to a second position different from the first position. In accordance with the puncher lock being disposed in the first position, a puncher head may move relative to a puncher casing. In accordance with the puncher lock being disposed in the second position, movement of the puncher head relative to the puncher casing may be prevented by the puncher lock. For example, and as shown in FIG. 4, locking ring 454 may be disposed in a first position. In the first position, movement of puncher head 446 relative to puncher casing 428 may be permitted by locking ring 454. Upon movement of locking ring 454 to a second position, and as further discussed below with regards to FIG. 5, disposition of locking ring 454 in the second position may prevent movement of puncher head 446 relative to puncher casing 428.

In various embodiments, a puncher lock may automatically lock a puncher head to a puncher casing, within the puncher casing, and/or otherwise prevent further movement of the puncher head relative to the puncher casing. The puncher lock may comprise an elastic material. The puncher lock may comprise a spring. For example, the puncher lock may comprise one or more of a tension spring, a torsion spring, a compression spring, or a torsion spring. A type of the spring may comprise one or more of a cantilever spring, coil spring, or spring washer. For example, locking ring 454 may comprise a spring washer. The puncher lock may automatically transition from a first state to a second state to lock the puncher head to the puncher casing. In some embodiments, the first state may comprise one of a compressed state or an expanded state. The second state may comprise a resting state. At least one dimension of the puncher lock in one of the first state or second state may be greater than the same respective dimension in the other of the second state or the first state. In the first state, the puncher lock may be disengaged with at least one of the puncher head or puncher casing. In the second state, the puncher lock may engage both of the puncher head and the puncher casing. In the second state, a portion of the puncher lock may be mechanically received in a corresponding recess of the at least one of the puncher head or the puncher casing with which the puncher lock is disengaged in the first state.

In various embodiments, a puncher lock may selectively prevent translation of a puncher head in at least one direction. The at least one direction may be oriented along a central axis of the puncher head. For example, locking ring 454 may prevent translation of puncher head 446 in at least one direction along axis A with brief reference to FIG. 5. The at least one direction may be opposite a second direction in which the puncher head translates prior to translation of the puncher lock from a first state to a second state. In some embodiments, the puncher lock may prevent further translation of the puncher head in the second direction upon transition of the puncher lock from the first state to the second state. In some embodiments, the at least one direction may be perpendicular to a direction in which the puncher lock engages the puncher head and/or the puncher casing upon transitioning from the first state to the second state.

In various embodiments, puncher head 446 may be configured as a component of a single-use puncher 424 such that puncher head 446 is substantially prevented from translated from a second position to a first position after being translated from the first position to the second position by the drive force. For example, a second recess 452 of puncher head 446 may be configured to receive locking ring 454 while puncher head 446 is in the second position, locking ring 454 partially extending into the second recess 452 and preventing puncher head 446 from returning to the first position. Locking ring 454 may be disposed within a channel recess between a first channel lining 462 and a second channel lining 464 while puncher head 446 is in the first position. An external surface of puncher head 446 may substantially prevent locking ring 454 from extending beyond the channel recess. Upon translation of puncher head 446 to the second position, the second recess 452 may be exposed to and permit the locking ring 454 to extend from the channel recess and into the second recess 452.

In various embodiments, and with reference to FIG. 5, a projectile launcher 100 may comprise a propulsion module 400. Propulsion module 400 may be similar to, or have similar aspects and/or components with, any propulsion module discussed herein (e.g., propulsion module 210, propulsion module 400 as depicted by FIG. 4, etc.). Propulsion module housing 402 of propulsion module 400 may comprise fluid channel 404, a first portion 406, a second portion 408, and a third portion 410, wherein the first portion 406, the second portion 408, and the third portion 410 are substantially similar to those described with reference to FIG. 4. The first portion 406 of the propulsion module housing 402 may be associated with breached propellant seal 502 and comprise fluid connection 504.

It should be noted that various components of propulsion module 400 may translate between a first position and a second position, transition from a first state to a second state, and/or otherwise be altered between a first time and a second time. The first state may be generally associated with the first position and exist in association with the first position during the first time. The first time may refer to an amount of time between assembly of propulsion module 400 and/or projectile launcher 100 and receipt of an activation signal by propulsion module 400. The second state may be generally associated with the second position and exist in association with the second position during the second time. The second time may refer to an amount of time between receipt of the activation signal and disassembly of propulsion module 400 and/or projectile launcher 100. The first position and the second position may refer to locations of one or more components in physical space relative to propulsion module 400 and/or projectile launcher 100. The first state and the second state may refer to configurations, alignments, shapes, and/or other features associated with components of propulsion module 400 and/or projectile launcher 100. Translation, transition, conversion, and/or other manipulations of components associated with propulsion module 400 and/or projectile launcher 100 may occur in response to and/or as a result of propulsion module 400 receiving the activation signal.

Fluid connection 504 may be formed upon propellant cannister 418 translating from a first position to a second position and needle 412 breaching propellant seal 420 (converting propellant seal 420 into breached propellant seal 502). The first position of propellant cannister 418 can be referred to as an initial position, a start position, a sealed position, an unpressurized position, and/or other position associated with propellant cannister 418 and/or propulsion module 400 preventing an amount of propellant being provided to projectile launcher 100. Upon puncher 424 receiving an activation signal, puncher 424 may cause propellant cannister 418 to be translated within propulsion module housing 402 to the second position. The second position of propellant cannister 418 can be referred to as an activated position, an active position, a connected position, a pressurized position, and/or other position associated with the propellant cannister 418 and propulsion module 400 being fluidly connected with and able to provide the amount of propellant to projectile launcher 100.

Fluid connection 504 may enable the amount of propellant to be provided to projectile launcher 100, via at least fluid channel 404, and launch one or more projectiles P. Breached propellant seal 502 permits the amount of propellant to leave propellant cannister 418 via fluid connection 504 to be directed and/or regulated by one or more components of projectile launcher 100. In some embodiments, fluid connection 504 may be closed, broken, and/or otherwise resealed by propulsion module 400 and/or by removing needle 412 from breached propellant seal 502. In some additional embodiments, fluid connection 504 may be regulated and/or modulated by one or more valves, flow rate regulators, and/or other fluid control components associated with propulsion module 400 and/or projectile launcher 100.

Second channel lining 464 may comprise an internal surface 506 configured to at least partially define the puncher channel. Additionally, second channel lining 464 may be associated with a first diameter D1, wherein the first diameter D1 may be associated with an inner diameter of the puncher channel, an outer diameter of primer wall 436, and/or an outer diameter associated with a first end of puncher head 446. Internal surface 506 may define an internal volume 508 associated with the puncher channel and puncher 424. Internal surface 506 may contact propulsion module cap 432 at a first end of the puncher channel (e.g., an end of the puncher channel proximate to propulsion module cap 432 and/or primer wall 436), extend along a central axis A of puncher 424, and contact locking ring 454 at a second end of the puncher channel (e.g., an end of the puncher channel proximate to propellant cannister 418). It should be noted that while internal surface 506 of second channel lining 464 may define a portion of the puncher channel, the puncher channel may be defined by puncher casing 428, propulsion module cap 432, and/or first channel lining 462 in addition to internal surface 506.

Internal volume 508 of the puncher channel may extend along a central axis A of puncher 424 from the first end of the puncher channel to at least puncher head 446. Internal volume 508 may be configured as an expansion chamber for expanding gases released by primer charge 442 that substantially contains the expanding gases. Expanding gases within internal volume 508 may apply a drive force to the puncher head 446 such that puncher head 446 translates within the puncher channel and along internal surface 506. Translation of puncher head 446 may increase the total volume of internal volume 508. Accordingly, internal volume may be associated with a first volume when puncher head 446 is in the first position and a second volume, greater than the first volume, when puncher head 446 is in the second position. It should be noted that primer wall 436 and/or primer cap 444 may partially define internal volume 508 in combination with and/or in place of propulsion module cap 432. For example, primer wall 436 may comprise a bounding portion 510 that at least partially defines a boundary of internal volume 508 within the puncher channel.

Primer wall 436 may be comprised of bounding portion 510 and external primer surface 512. Bounding portion 510 may be configured to define internal volume 508 and direct the drive force to puncher head 446. External primer surface 512 may be configured to couple with, attach to, and/or otherwise combine with internal surface 506 of second channel lining 464.

External primer surface 512 and internal surface 506 may be configured to secure primer wall 436 within and/or proximate to the puncher channel defined by the internal surface. For example, external primer surface 512 may comprise threading, adhesive, protrusions, latches, and/or other coupling components that permanently and/or removably couple primer wall 436 within the puncher channel. Additionally, external primer surface 512 may be configured to substantially prevent removal, displacement, and/or other movement of primer wall 436 within the puncher channel during translation of puncher head 446. Puncher head 446 may translate relative to puncher casing 428 with which external primer surface 512 and/or internal surface 506 may be integrated.

Primer contact 514 may be associated with primer contact 440 at a second time after primer contact 440 received the activation signal. Primer contact 514 may be electrically isolated from at least primer ignition plate 438. Alternatively, or in addition, primer contact may be electrically isolated from at least second channel lining 464 and/or propulsion module housing 402. Primer contact 440 and primer contact 514 may be a first state and a second state of a single component. For example, and in response to receiving an activation signal, primer contact 440 may transition and become primer contact 514. Where primer contact 440 is electrically connected with conductive plate 434 and primer ignition plate 438, primer contact 514 may electrically disconnect and/or isolate conductive plate 434 and primer ignition plate 438. Where primer contact 440 is electrically connected with primer ignition plate 438 and propulsion module housing 402, primer contact 514 may electrically disconnect and/or isolate primer ignition plate 438 and propulsion module housing 402. As previously noted, primer contact 440 may reversibly, permanently, and/or temporarily transition into primer contact 514, wherein primer contact 514 may disconnect conductive plate 434 and primer ignition plate 438 through a deformed wire, an electrical switch, a fuse, and/or other component that may enable electrical connection in the first state and electrically disconnect in the second state.

Travel distance 516 may be associated with translation of various components from a first position to a second position in response to an activation signal. Travel distance 516 may refer to a distance between primer cap 444 and a base portion 518 of puncher head 446, a first position of puncher head 446 and a second position of puncher head 446 associated with the second state of propulsion module 400, a first position of propellant cannister 418 and a second position of propellant cannister 418, and/or propellant seal 420 and head seal 414 associated with the first state of propulsion module 400. Travel distance 516 may refer to a minimum travel distance associated with causing needle 412 to breach propellant seal 420 and form fluid connection 504. Accordingly, travel distance 516 may be associated with a translation path of various components within propulsion module 400 between the first position and the second position associated with the various components.

Base portion 518 of puncher head 446 may define internal volume 508 in combination with one or more of puncher casing 432, primer cap 444, internal surface 506, and/or bounding portion 510. Base portion 518 may reference a portion of puncher head 446 that defines internal volume 508, fluidly isolated from a second volume of the puncher channel and/or propulsion module 400, in combination with puncher seal 448.

Channel recess 520 may be a recess formed by puncher casing 428, first channel lining 462, second channel lining 464, other structure associated with the puncher channel. Channel recess 520 may be configured as previously discussed with reference to FIG. 4. Channel recess 520 may be partially defined by a portion of the first channel lining 462 and a portion of the second channel lining 464 that extend substantially perpendicular to central axis A, the portion of the first channel lining 462 and the portion of the second channel lining 464 spaced apart to receive locking ring 454 having a thickness T. Channel recess 520 may comprise an opening that permits locking ring 454 to extend into a second recess 452 when puncher head 446 translates into the second position. The portion of the first channel lining 462 and the portion of the second channel lining 464 may extend into the puncher channel to be substantially adjacent to puncher head 446. Accordingly, channel recess 520 may substantially contain locking ring 454 while puncher head 446 is in the first position and partially contain locking ring 454 while puncher head 446 is in the second position.

In various embodiments, a puncher may comprise a puncher head stop. The puncher head stop may comprise a mechanical element configured to limit travel of a puncher head associated with the puncher. For example, the puncher head stop may comprise one or more of a ledge, flange, and/or other protrusion positioned to contact at least a portion of the puncher head upon movement of the puncher head from a first position to a second position. Additionally, the puncher head stop may be configured to contact at least a portion of a puncher lock that has engaged the puncher head. Contact between the puncher head stop and at least one of the puncher head and/or the puncher lock may substantially prevent movement of the puncher head in at least one direction. The one direction may be substantially parallel to a central axis of the puncher head. Accordingly, the puncher head stop may be configured to at least partially limit movement of the puncher head upon translation of the puncher head from the first position to the second position.

Puncher head stop 522 may be a portion of second channel lining 464 that extends substantially perpendicular to central axis A and substantially prevents puncher head 446 from translating beyond the second position. In some embodiments, puncher head stop 522 may be configured to at least partially define channel recess 520. In some additional embodiments, locking ring 454 may be configured to prevent translation of puncher head 446 beyond the second position in a manner similar to puncher head stop 522 through contact with lock stop 524. In some further embodiments, puncher head stop 522 may be formed independent of channel recess 520 and locking ring 454. Independent of the various embodiments, puncher head stop 522 may be associated with a portion of the puncher channel having a second diameter D2. As previously noted, internal surface 506 may be associated with a portion of the puncher channel having a first diameter D1, the first diameter D1 being greater than the second diameter D2. Puncher head stop 522 may extend radially inward from internal surface 506 from the first diameter D1 to the second diameter D2. Accordingly, puncher head stop 522 may contact puncher head surface 526 during translation of puncher head 446 to prevent further translation of puncher head 446 from the second position.

In various embodiments, a puncher may comprise a lock stop configured to limit travel of a puncher head and/or a puncher lock. The lock stop may comprise a mechanical element. For example, the lock stop may comprise one or more of a ledge, flange, or protrusion positioned to contact the puncher head and/or the puncher lock upon movement of at least one of the puncher head and or the puncher lock. Additionally, the lock stop may be configured to contact at least a portion of the puncher lock, wherein the puncher lock may contact the lock stop before and/or after the puncher lock has engaged the puncher head. Contact between the lock stop and the puncher lock may substantially prevent movement of the puncher head in at least one direction. The one direction may be substantially parallel to a central axis of the puncher head. Accordingly, the lock stop may be configured to at least partially limit movement of the puncher head upon translation of the puncher head from the first position to the second position.

Lock stop 524 may be a portion of first channel lining 462 that extends substantially perpendicular to central axis A. As discussed above, lock stop 524 may prevent locking ring 454 and puncher head 446, where locking ring 454 has extended into second recess 452, from traversing past the second position within the puncher channel. For example, locking ring 454 may extend into the second recess 452 such that a first surface of locking ring 454 contacts puncher head surface 526 during translation between the first position and the second position. Upon translating to the second position, a second surface, opposite the first surface, of locking ring 454 may contact lock stop 524 and substantially prevent additional translation of puncher head 446 and propellant cannister 418 towards head seal 414. As locking ring 454 contacts lock stop 524 while in contact with puncher head surface 526, lock stop 524 may substantially prevent additional translation of puncher head 446 via puncher head surface 526. Additionally, lock stop 524 and puncher head stop 522 may prevent additional translation of puncher head 446 via locking ring 454. As discussed above, locking ring 454 may substantially prevent translation of puncher head 446 towards propellant cannister 418 and head seal 414 beyond the second position via contact with lock stop 524. Further, locking ring 454 may substantially prevent translation from the second position towards the first position through contact with puncher head stop 522. For example, the second surface of locking ring 252 may contact the second recess 452 and the first surface of locking ring 454 may contact puncher head stop 522.

First channel lining 462 and second channel lining 464 may be removably and/or permanently coupled at interface 528 to maintain channel recess 520 with an axial height (e.g., distance along central axis A that puncher head stop 522 is spaced from lock stop 524) greater than or equal to thickness T.

Locking ring 454 may be configured as a structure that is disposed radially outward from puncher head 446 within channel recess 520 and experiences a contractive force while puncher head 446 is in the first position. The contractive force may be applied by a material of locking ring 454 when locking ring 454 is installed in channel recess 520 during assembly of puncher 424. For example, and during assembly, puncher head 446 may be placed within the puncher channel within second channel lining 464 such that at least puncher cup 456 extends from an opening in puncher head stop 522 having an inner diameter substantially equal to the second diameter D2. Installation of locking ring 454 may put locking ring 454 under the contractive force due to an opening, a stretching, a dilating, and/or otherwise deforming locking ring 454 into the first state disposed radially external to puncher head 446. Deformation of locking ring 454 during installation causes the contractive force to be applied by the material of locking ring 454 attempting to transition locking ring 454 from the first state to the second state (e.g., a rest state, a base state, a natural state, an initial state, etc.).

In various exemplary embodiments, propulsion module 400 may be configured to contain propellant cannister 418 in a first position associated with a first state at a first time and cause propellant cannister 418 to translate into a second position associated with a second state at a second time. During assembly of propulsion module 400, propellant cannister 418 may be inserted into propulsion module housing 402 via an opening in the third portion 410, the opening being associated with the third portion when puncher 424 is decoupled from propulsion module housing 402. Insertion of propellant cannister 418 may be guided by propulsion module housing 402 such that cannister neck 422 is disposed radially within cannister collar 416 and proximate to needle 412. Upon insertion of propellant cannister 418, and alignment with various components associated with the first portion 406, puncher 424 may be coupled with third portion 410 to secure propellant cannister 418 in the first position. It should be noted that cannister collar 416 may be configured to resist contact between and/or maintain space between needle 412 and propellant seal 420. Alternatively, or in addition, propellant seal 420 may be aligned with and contact needle 412 in the first position.

In various exemplary embodiments, propulsion module 400 may be associated with a first state upon insertion of propellant cannister 418 within propulsion module housing 402, coupling puncher 424 with the third portion 410, and assembly of propulsion module 400. It should be noted that propulsion module 400 may be integrated with projectile launcher 100 such that assembly of propulsion module 400 disposes propellant cannister 418 and/or puncher 424 in proximity to, communication with, and/or within various components of projectile launcher 100 (e.g., housing 102, magazine 104, housing interface 208, propulsion components of projectile launcher 100, etc.). Alternatively, or in addition, propulsion module 400 may be assembled prior to any association with projectile launcher 100. Upon assembly of propulsion module 400 independent of projectile launcher 100, propulsion module may be inserted within, coupled to, and/or otherwise associated with handle end 112 and/or other components of projectile launcher 100. Further, assembly of propulsion module 400 and/or association of propulsion module 400 with projectile launcher 100 may form an electrical communication path between at least primer contact 440 and a control system (e.g., processing circuit 302, user interface 304, signal generator 308, trigger 108, control interface 110, etc.) associated with projectile launcher 100.

In various embodiments, propulsion module 400 may be activated by an activation signal received from the control system associated with projectile launcher 100. For example, the activation signal may be transmitted to primer contact 440 via conductive plate 434 and cause primer contact 440 to trigger primer charge 442 via primer ignition plate 438. Alternatively, the activation signal may be transmitted to primer contact 440 via primer ignition plate 438 and cause primer contact to trigger primer charge 442 via a resistive wire and/or other component of primer contact 440. The activation signal may initiate transitions between the first state and the second state that cause translation from the first position to the second position. The activation signal may cause generation of thermal energy by primer contact 440 and/or primer ignition plate 438, the thermal energy triggering the primer charge 442 to ignite and primer contact 440 to deform. Deformation of primer contact 440 may comprise primer contact 440 transitioning from the first state where primer contact 440 is in electrical communication with primer ignition plate 438 to the second state where primer contact 514 is electrically isolated from primer ignition plate 438. Alternatively, or in addition, deformation of primer contact 440 may comprise primer contact 440 transitioning from the first state where primer contact 440 is in electrical communication with second channel lining 464 and/or propulsion module housing 402 to the second state where primer contact 514 is electrically isolated from second channel lining 464 and/or propulsion module housing 402. Further, it should be noted that electrically isolated may comprise embodiments where conductive material 530 electrically connects at least primer ignition plate 438 and propulsion module housing 402.

Ignition of primer charge 442 may cause an amount of gas to exert a drive force within internal volume 508 that is applied to puncher head 446. Based at least on primer wall 436, primer ignition plate 438, first channel lining 462, second channel lining 464, and/or surrounding components being substantially secured and prevented from translating, the drive force may cause puncher head 446 to translate between the first position and the second position within the puncher channel. Independent of permanent, transitory, and/or removable coupling, puncher casing 428 and propulsion module cap 432 may be coupled to propulsion module housing 402 to substantially prevent translation and/or displacement of primer wall 436, primer ignition plate 438, first channel lining 462, second channel lining 464. Accordingly, the drive force may translate puncher head 446 from the first position to the second position as the amount of gases generated by primer charge 442 expands within internal volume 508.

Ignition of primer charge 442 may generate sufficient thermal energy to cause primer contact 440 to break an electrical communication path between primer ignition plate 438 and propulsion module housing 402. Alternatively, or in addition, ignition of primer charge 442 may deposit an amount of conductive material 530 (e.g., conductive carbon) sufficient to form the electrical communication path in place of primer contact 440. For example, combustion of primer charge 442 may form conductive materials 530, from the material of primer charge 442, and deposit conductive materials 530 onto at least primer wall 438, primer ignition plate 438, second channel lining 464, and/or primer contact 514. Additionally, conductive materials 530 may permit the transmission of one or more signals after the activation signal has been transmitted to primer contact 440. Further, conductive materials 530 may be associated with a connection resistance greater than the resistance associated with primer contact 440.

Translation of puncher head 446 from the first position to the second position may cause propellant container 418 to translate from the first position to the second position and transition propellant seal 420 from the first state to the second state where propellant seal 420 becomes breached propellant seal 502. For example, puncher head 446 may be in contact with propellant cannister wall 426 in the first position and application of the drive force to puncher head 446 applies the drive force to propellant cannister 418. The drive force may cause the propellant cannister 418 and the puncher head 446 to translate along a central axis A by a travel distance 516 to the second position. Additionally, the drive force may be sufficient to cause the needle 412 to breach propellant seal 420 and form fluid connection 504 between propellant cannister 418 and fluid channel 404. Accordingly, primer charge 442 may be configured such that the amount of gas produced by ignition of primer charge 442 provide the drive force sufficient to translate propellant cannister 418 and puncher head 446 from the first position to the second position and cause needle 412 to breach propellant seal 420.

Translation of puncher head 446 from the first position to the second position may cause locking ring 454 to transition from the first state associated with the first position of puncher head 446 to the second state associated with the second position of puncher head 446. Deformation of locking ring 454 into the first state places locking ring 454 under a contractive force that transitions locking ring 454 from the first state to the second state upon puncher head 446 translating to the second position. For example, propulsion module cap 432 may substantially prevent locking ring 454 from transitioning from the first state to the second state while puncher head 446 is in the first position. As the drive force is applied to the puncher head 446 and causes the puncher head 446 to translate to the second position, the second recess 452 may translate along central axis A such that locking ring 454 is radially external to the second recess 452. Upon the second recess 452 (or a portion of the second recess 452) being substantially aligned with channel recess 520, the contractive force may transition locking ring 454 from the first state to the second state such that a portion of locking ring 454 extends into the second recess 452.

Puncher head 446 may translate to the second position by extending through an opening in the first channel lining 462 having an inner diameter equal to second diameter D2. Puncher head 446 may extend by at least the travel distance 516 and be substantially secured in the second position by locking ring 454. Additionally, puncher head 446 may further secure propellant cannister 418 in the second position by locking ring 454 extending into the second recess 452. Accordingly, puncher head 446 and locking ring 454 may secure the amount of propellant within propellant cannister 418 in fluid communication with projectile launcher 100 via fluid connection 504 and fluid channel 404.

Figure 6:
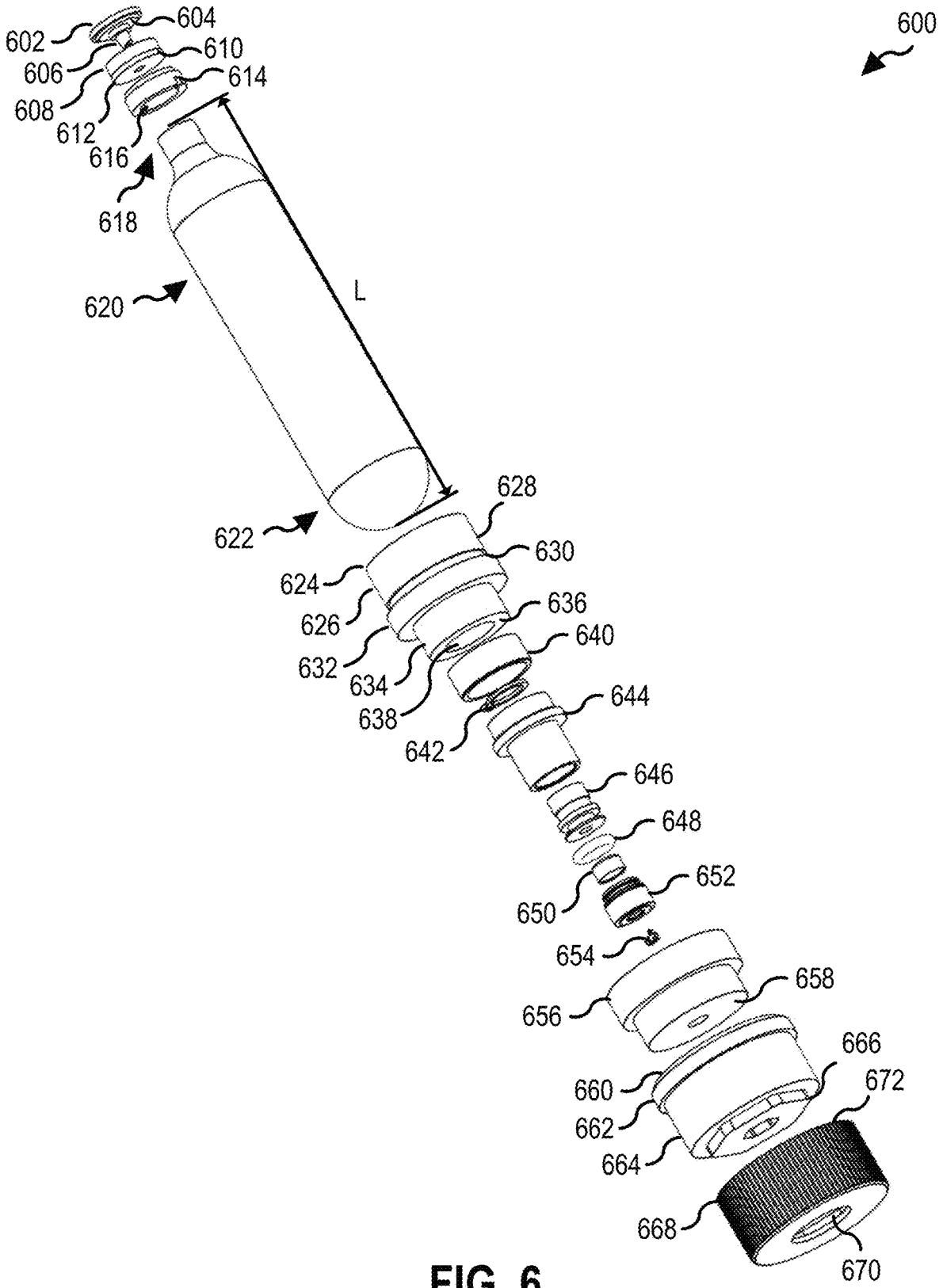
FIG. 6 is a perspective view of a propulsion module for a projectile launcher, in accordance with various embodiments.

In various embodiments, and with reference to FIG. 6, a propulsion module 600 may be comprised of a series of components with a shared central axis when assembled. Propulsion module 600 may be similar to, or have similar aspects and/or components with, any propulsion module discussed herein (e.g., propulsion module 210, propulsion module 400 as depicted by FIGS. 4 and 5, etc.). It should be noted that while various components of propulsion module 600 are aligned to and ordered along a central axis, individual components may be disposed parallel to and/or independent from the central axis. Additionally, the various components of propulsion module 600 may be reordered in various embodiments of propulsion module 600.

Needle 602 may be configured similar to any needle, puncturing structure, and/or coupling structure discussed herein (e.g., needle 412). Needle 602 may be comprised of a needle baseplate 604 and/or a needle shaft 606. Needle baseplate 604 may be a component of needle 602 that extends radially outward from the central axis to a needle baseplate outer diameter. Needle baseplate 604 may be configured as a sealing surface for propellant cannister 620, a coupling surface for head seal 608, and/or a coupling surface for cannister collar 614. Additionally, needle baseplate 604 may be configured to include a fluid channel that extends through needle baseplate 604 to needle shaft 606. The fluid channel may extend through needle baseplate 604 at the central axis, parallel to the central axis, and/or removed from the central axis (e.g., perpendicular to the central axis, angled relative to the central axis, etc.).

Needle shaft 606 may extend from needle baseplate 604 and may be in fluid communication with the fluid channel that extends through fluid baseplate 604. Needle shaft 606 may be configured as a hollow structure that punctures a cannister seal (e.g., propellant seal 420, breached propellant seal 502, etc.) of propellant cannister 620 and/or couples with propellant cannister 620 to form a fluid connection (e.g., fluid connection 504) between the fluid channel and an internal volume of propellant cannister 620. Needle shaft 606 may be configured to have an internal shaft diameter determined to permit at least a minimum flow rate of propellant be provided from the propellant cannister 620 to projectile launcher 100. Additionally, needle shaft 606 may be configured to have a shaft length that enables needle shaft 606 to extend into the internal volume of propellant cannister 620, optionally through head seal 608, cannister collar 614, and/or a cannister seal.

Head seal 608 may be comprised of an external sealing surface 610 and a head sealing surface 612. Head seal 608 may be configured to substantially prevent propellant provided from propellant cannister 620 from leaking escaping, and/or otherwise exiting propulsion module 600 via paths other than needle shaft 606. Additionally, head seal 608 may be configured to compress from a first axial thickness to a second axial thickness as propellant cannister 620 translates from a first position to a second position. In various embodiments, head seal 608 may extend radially outward from the central axis to a head seal outer diameter, wherein the head seal outer diameter may be substantially equal to the needle baseplate outer diameter. Alternatively, or in addition, head seal outer diameter may be greater than needle baseplate outer diameter such that external sealing surface 610 contacts a propulsion module wall (e.g., propulsion module housing 402). Further, an internal seal channel of head seal 608 may be configured to permit needle shaft 606 to extend through head seal 608 and form a substantially fluid-tight seal with an external surface of needle shaft 606.

External sealing surface 610 may be disposed on and/or may be a radially external surface of head seal 608 that is configured to form a substantially fluid-tight seal with a propulsion module wall, a projectile launcher housing (e.g., housing 102), and/or other component of projectile launcher 100. External sealing surface 610 and head sealing surface 612 may be a single component (e.g., external sealing surface 610 is an external portion of head sealing surface 612) or separate sub-components of head seal 608.

Head sealing surface 612 may be disposed along the central axis of propulsion module 600 and proximate to propellant cannister 620 in a first position. Additionally, head sealing surface 612 may be configured to contact propellant cannister 620 in a second position and form a substantially fluid-tight seal with propellant cannister 620. For example, head sealing surface 612 may be disposed in proximity to and spaced from propellant cannister 620 by an initial distance when propellant cannister 620 is in the first position. Propellant cannister 620 may translate from the first position to a second position, wherein the propellant cannister 620 may contact and/or compress head sealing surface 612 to form the substantially fluid-tight seal.

In various embodiments, needle shaft 606 and head sealing surface 612 may be integrated into a single component that couples with an interface of propellant cannister 620. For example, propellant cannister 620 may comprise a cannister seal configured to couple and decouple with needle shaft 606 and/or head sealing surface 612. During translation into the second position, needle shaft 606 may compress, pierce, breach, open, and/or otherwise couple with a portion of the cannister seal to create a fluid connection. Additionally, head sealing surface 612 may be configured to permit propellant to flow around and/or into needle shaft 606 to the fluid channel. Further, and based on propellant cannister translating from the second position to the first position or a third position, needle shaft 606 and head sealing surface 612 may decouple from the cannister seal. Where cannister seal is a multi-use seal, the portion of the cannister seal may decompress, return to an initial state, and/or otherwise reseal propellant cannister 620.

Cannister collar 614 may be configured as a ring, a tube, a hollow cylinder, a hollow prism, and/or other three-dimensional shape that receives cannister neck 618. A collar outer diameter may be substantially equal to at least one of the needle baseplate outer diameter and/or head seal outer diameter. Alternatively, or in addition, collar outer diameter may be less than the needle baseplate outer diameter. A collar inner diameter may be greater than or equal to a cannister neck outer diameter and enable cannister neck 618 to fit within cannister collar 614. Cannister collar 614 may be slightly flared, have a variable collar inner diameter, and/or otherwise be shaped to receive and/or align cannister neck 618 with needle shaft 606. For example, a first collar inner diameter may be greater than a second collar inner diameter, wherein the first collar inner diameter is associated with an opening that receives cannister neck 618 upon insertion of propellant cannister 610 within propulsion module 600 and the collar inner diameter is reduced to the second collar inner diameter to align cannister neck 618 with needle shaft 606. Alignment of cannister neck 618 with needle shaft 606 may refer to the cannister collar 614 causing needle shaft 606 to share an axis with cannister neck 618 and/or enabling needle shaft 606 to extend into cannister neck 618 when propellant cannister 620 is in the second position. Reduction of the collar inner diameter from the first collar inner diameter to the second collar inner diameter may reference a sloped internal surface 616 of cannister collar 614 that guides cannister neck 618 into alignment with needle shaft 606.

Internal surface 616 of cannister collar 614 may be configured to align cannister neck 618 with needle shaft 606. Additionally, internal surface 616 may be configured to form a substantially fluid-tight seal with an external surface of cannister neck 618. For example, during translation of propellant cannister 620 from the first position to the second position, cannister neck 618 may contact internal surface 616 such that at least the amount of propellant is substantially prevented from leaking escaping, and/or otherwise passing between internal surface 616 and cannister neck 618.

Propellant cannister 620 may be configured as a container, cannister, bottle, and/or other chamber that contains an amount of propellant and may be similar to, or have similar aspects and/or components with, any propellant cannister discussed herein (e.g., propellant cannister 418). Propellant cannister 620 may be configured to have a length L that extends along and/or parallel to the central axis of propulsion module 600, length L including cannister neck 618 and cannister base 622. Cannister base 622 may be configured as a semi-sphere, a semi-ellipsoid, and/or other three-dimensional shape that fits at least partially within puncher opening 624 of puncher casing 626.

Puncher casing 626 may be comprised of puncher opening 624, a first external casing surface 628, a recess 630, a step 632, a second external casing surface 634, puncher base 636, and puncher channel 638. Puncher casing 626 may be similar to, or have similar aspects and/or components with, any puncher casing, piston casing, and/or other housing for a puncher or piston discussed herein (e.g., puncher casing 428). Additionally, various embodiments of puncher casing 626 may omit individual portions and/or components of puncher casing 626.

First external casing surface 628 may be configured to be inserted and/or couple with a propulsion module housing and/or a projectile launcher housing. For example, first external casing surface 628 may be disposed on a radially external portion of puncher casing 626 and have an external casing diameter less than or equal to an internal housing diameter of the propulsion module housing and/or the projectile launcher housing. First external casing surface 628 may couple with the propulsion module housing and/or the projectile launcher housing via a threading interface. Alternatively, or in addition, the propulsion module housing and/or the projectile launcher housing may secure the first external casing surface 628 via a protrusion and/or other coupling mechanism that engages with recess 630.

Puncher channel 638 may be configured to receive and secure locking cap 640 (e.g., a puncher casing cap, a channel cap, etc.), locking ring 642 (e.g., a puncher lock, a lock ring, etc.), channel lining 644, puncher head 646, puncher internal seal 648, primer cap 650, puncher drive 652, and/or puncher connector 654 (e.g., puncher components). Puncher channel 638 may be configured to substantially contain puncher components for translating propellant cannister from the first position to the second position in response to an activation signal received from projectile launcher 100. Puncher channel 638 may be configured to extend along the central axis of propulsion module 600 and may be associated with an internal channel diameter.

Puncher components disposed within puncher channel 638 may be at least partially secured by internal cap wall 656. For example, locking cap 640, locking ring 642, channel lining 644, puncher head 646, puncher internal seal 648, primer cap 650, puncher drive 652, and/or puncher connector 654 may be disposed along the central axis of propulsion module 600 between cannister base 622 and internal cap wall 656. Alternatively, or in addition, locking cap 640 may be removably and/or permanently attached with puncher channel 638 proximate to cannister base 622 in the first position such that the puncher components are disposed substantially between locking cap 640 and internal cap wall 656. Internal cap wall 656 may be configured such that second external casing surface 634 fits radially within internal cap wall 656. Internal baseplate 658 may extend radially from the central axis and comprises a baseplate opening exposing conductive plate 660 to puncher connector 654. Additionally, puncher connector 654 may be disposed within and/or extend through the baseplate opening of internal baseplate 658 to contact puncher drive 652. Accordingly, internal cap wall 656 may be configured to space puncher casing 626 and various puncher components from conductive plate 660 and internal baseplate 658 may be configured to permit puncher connector 654 to for an electrical communication path with at least puncher drive 652 and conductive plate 660.

Conductive plate 660 may be similar to, or have similar aspects and/or components with, any conductive plate associated with a puncher cap and/or piston cap discussed herein (e.g., conductive plate 434). For example, conductive plate 660 may comprise conductive ring 662, connector plate 664, and cap interface 666. Additionally, conductive plate 660 may be formed from substantially any conductive material capable of receiving and/or transmitting one or more signals associated with at least puncher connector 654. Conductive ring 662 may be a ring, a band, a tube, a cylinder, and/or other three-dimensional shape that is disposed radially external to connector plate 664. Further, conductive ring 662 may be configured such that internal cap wall 656 and external cap wall 668 permit a propulsion module housing and/or a projectile launcher to electrically connect and/or communicate with and via conductive ring 662.

Conductive ring 662 may be configured such that a projectile housing contact forms an electrical path to puncher connector 654 through conductive ring 662, connector plate 664, and/or cap interface 666. Additionally, while conductive ring 662 is commonly exposed for electrical connection by internal cap wall 656 and external cap wall 668, conductive ring 662 may be exposed by any combination of structural components associated with the propulsion module 600 (e.g., puncher casing 626, step 632, propulsion module housing 402, etc.). Connector plate 664 may extend between conductive ring 662 and at least puncher connector 654. Conductive ring 662, connector plate 664, and primer activator 654 may form an electrical communication path that causes various puncher components to transition from a first state to a second state and translate at least propellant cannister 620 from the first position to the second position.

Cap interface 666 may be coupled to and/or be configured as a portion of connector plate 664. Cap interface 666 may be further configured to couple with cap interface socket 670 of external cap wall 668 such that external cap wall 668 secures internal cap wall 656 and conductive plate 660 to a propulsion module housing. For example, external cap wall 668 may comprise threading that couples with a propulsion module housing and/or other components of projectile launcher 100, wherein cap interface 666 fits within cap interface socket 670 and maintains orientation between conductive plate 660 and external cap wall 668 (e.g., manipulation of external cap wall 668 is transferred to conductive plate 660. Cap interface 666 may couple with cap interface socket 670 such that coupling external cap wall 668 with the propulsion module housing electrically connects conductive ring 662 with an electrical contact of the propulsion module housing. For example, External cap wall 668 may extend from the central axis to a diameter such that an internal surface 672 of external cap wall 668, extending parallel to the central axis and disposed at the diameter from the central axis, is spaced from conductive ring 662 and connector plate 664. Accordingly, coupling external cap wall 668 with the propulsion module housing may permit the electrical contact of the propulsion module to fit between conductive plate 660 and the internal surface 672 to contact conductive ring 662.

External cap wall 668 may be configured as a housing overmold (e.g., a portion of material formed to fit over a housing for ergonomic, utility, and/or other usability purposes), a cap overmold, a handle, a user grip, and/or other grasping structure that enables a user of projectile launcher 100 to manipulate at least a portion of propulsion module 600. As noted above, a user may manipulate external cap wall 668 to assemble, replace, modify and/or otherwise alter propulsion module 600. For example, external cap wall 668 may be coupled to propulsion system 600 (e.g., screwing the external cap wall 668 onto threading associated with recess 630 and/or step 632) by the user and utilized to align various components of propulsion module 600. Additionally, external cap wall 668 may cause components of propulsion module 600 to align during assembly such that puncher drive 652 translates propellant cannister 620 from the first position to the second position.

Figure 7A:
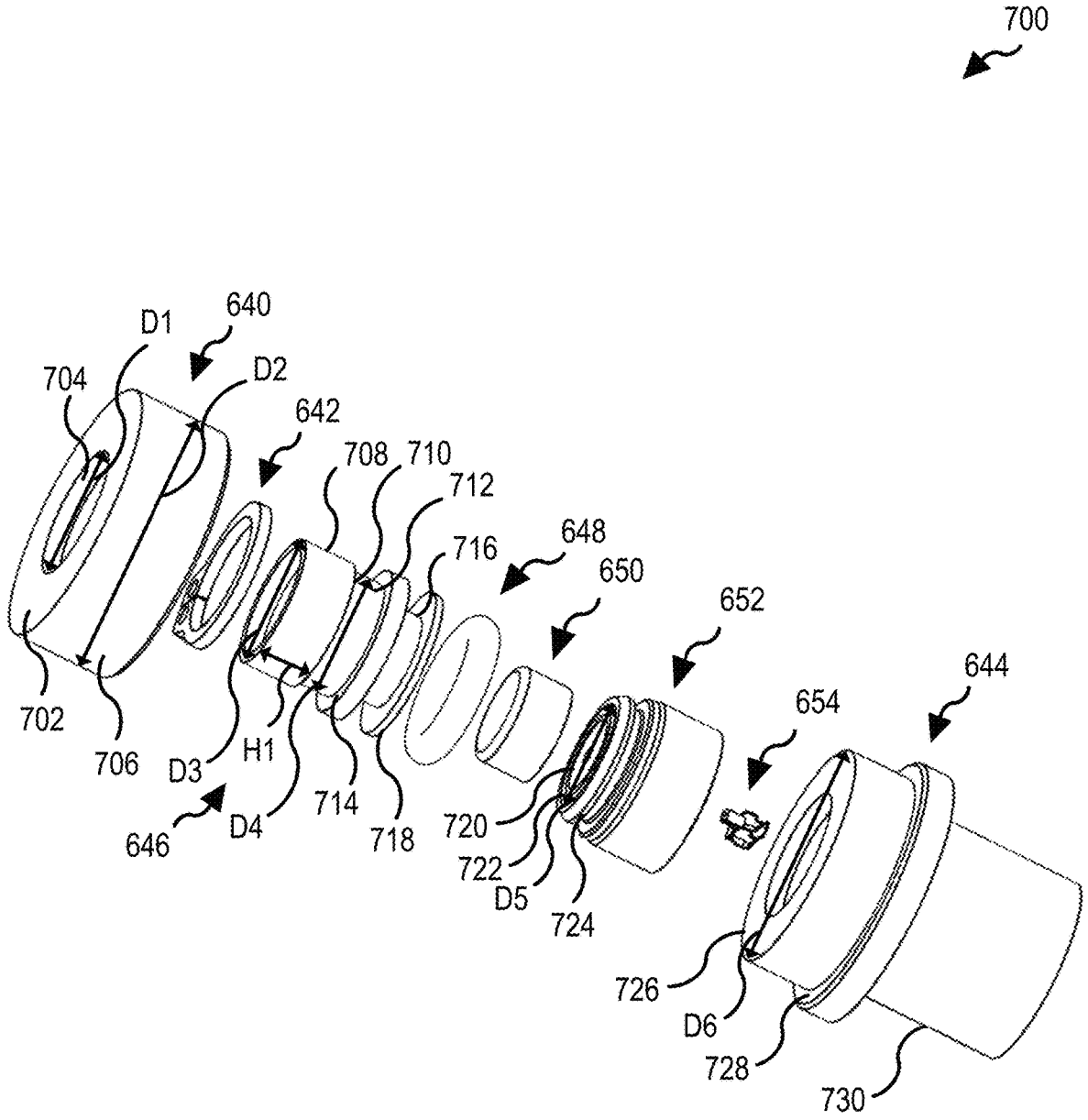
FIG. 7A is a perspective view of a puncher associated with a propulsion module, in accordance with various embodiments.
Figure 7B:
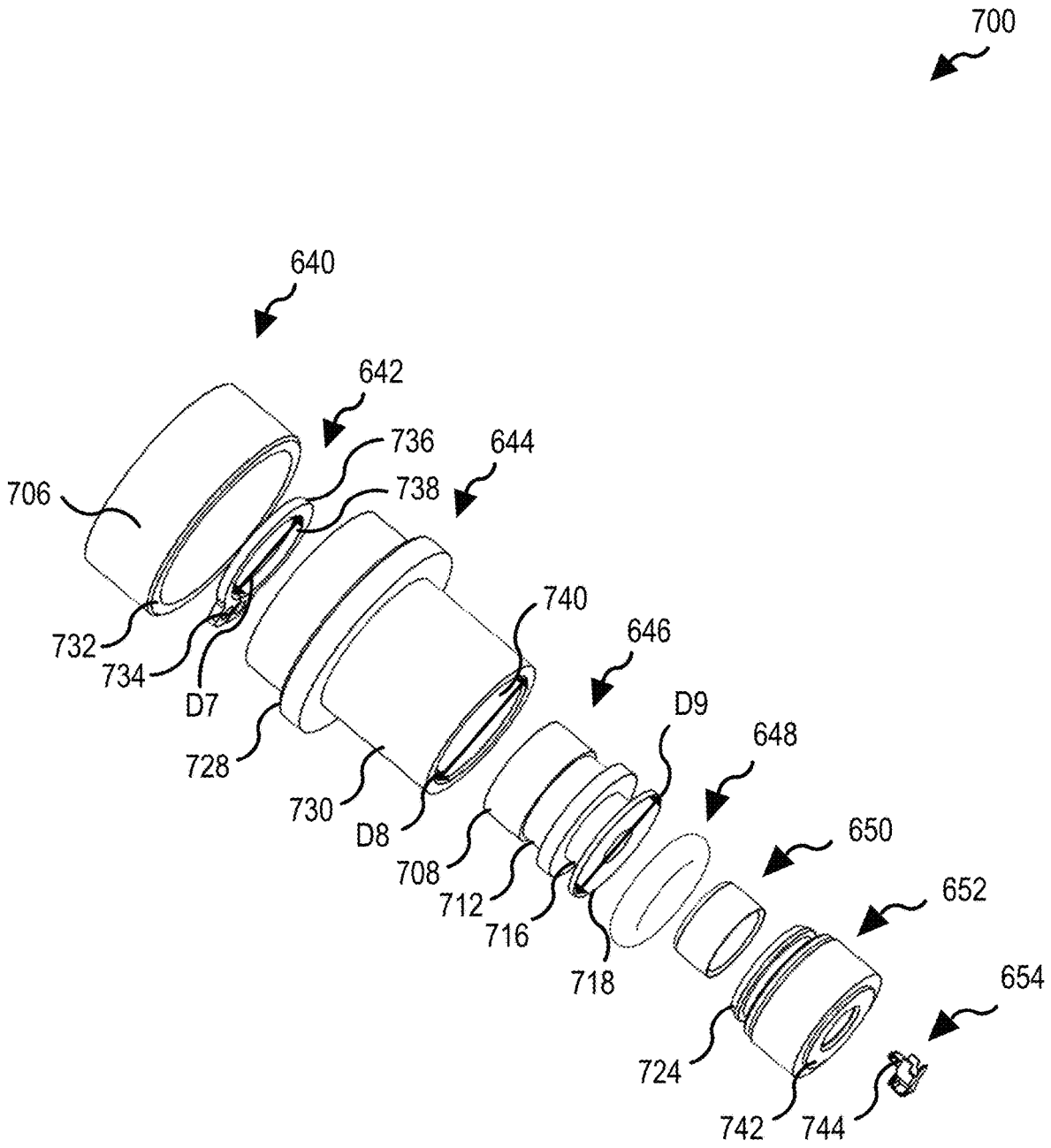
FIG. 7B is a perspective view of a puncher associated with a propulsion module, in accordance with various embodiments.

In various embodiments, and with reference to FIGS. 7A and 7B, the propulsion module 600 may be comprised of a series of puncher components 700 (e.g., various puncher components including locking cap 640, locking ring 642, channel lining 644, puncher head 646, puncher internal seal 648, primer cap 650, puncher drive 652, and puncher connector 654) with a shared central axis when assembled. Puncher components 700 may be similar to, or have similar aspects and/or components with, any puncher and/or piston discussed herein (e.g., puncher 424, etc.). It should be noted that while puncher components 700 of propulsion module 600 are aligned to and ordered along a central axis, individual puncher components may be disposed parallel to and/or independent from the central axis. Additionally, puncher components 700 of propulsion module 600 may be reordered in various embodiments of propulsion module 600.

Locking cap 640 may be configured to define a cannister-facing end of puncher components 700. For example, when puncher components 700 are assembled to form a puncher of propulsion module 600, first locking cap surface 702 may be disposed adjacent to and/or in contact with propellant cannister 620. First locking cap surface 702 may extend radially outward from a first opening 704 and define a first opening diameter D1. Additionally, first locking cap surface 702 may extend radially outward to a locking cap diameter D2. A second locking cap surface 706 may extend along the central axis and define an internal volume of locking cap 640.

First locking cap surface 702 may be configured to define the cannister-facing end of locking cap 640. Additionally, first locking cap surface 702 may be configured to substantially prevent movement locking ring 642, channel lining 644, puncher head 646, puncher internal seal 648, primer cap 650, and/or other puncher components from translating beyond a second position after an activation signal has been received. First locking cap surface 702 may be configured as and/or comprise lock stop 524 as described with reference to FIG. 5.

First opening 704 may be configured to permit a first portion 708 of puncher head 656 to at least partially extend through first opening 704 and contact propellant cannister 620. Additionally, first opening 704 may be configured such that the first opening diameter D1 substantially prevents locking ring 642 from passing through first opening 704.

Second locking cap surface 706 may be configured to define a radially external surface of puncher components 700. For example, second locking cap surface 706 may at least partially define an outmost surface of puncher components 700 that fits within puncher casing 626 and couples with an inner surface of puncher casing 626. Second locking cap surface 706 may be configured to fit within puncher casing 626 such that locking cap 620 is radially internal to first external casing surface 628, recess 630, and/or step 632. Additionally, second locking cap surface 706 may be configured to align and/or locate first opening 704 in proximity to puncher opening 624.

Puncher head 646 may be configured to be inserted within at least locking cap 640 such that first portion 708 of the puncher head 646 may align with and/or extend through first opening 704. For example, first portion 708 may be configured as a cylinder having a puncher head diameter D3 and a puncher head height H1. Puncher head diameter D3 may be less than or equal to first opening diameter D1 and puncher head height H1 may be substantially equal to and/or less than a travel distance between the first position and the second position of propellant cannister 620. Additionally, first portion 708 may be configured to be partially and/or completely hollow to enable seating of and/or coupling with cannister base 622.

Puncher head 646 may comprise first portion 708, first head stop 710 (e.g., first lock stop), locking recess 712, second head stop 714 (e.g., second lock stop), sealing recess 716, and puncher head base plate 718. First head stop 710, locking recess 712, and/or second head stop 714 may be configured to secure puncher head 646 after translation of propellant cannister 620 to the second position. For example, and in response to puncher connector 654 receiving the activation signal, puncher head 646 may translate propellant cannister 620 from the first location to the second location under a drive force. Translation of propellant cannister 620 to the second position may be accomplished by at least puncher head height H1 extending through first opening 704 such that locking ring 642 is received by and extends into locking recess 712. Upon locking recess 712 receiving locking ring 642, further translation beyond the second position (relative to a starting point of the first position) may be substantially prevented by second head stop 714. Similarly, translation from the second position to the first position may be substantially prevented by first head stop 710.

Locking recess 712 may be configured with a lock recess diameter D4 less than puncher head diameter D3 such that extension of first portion 708 through first opening 704 causes locking ring 642 to be disposed radially outward from locking recess 712. Locking ring 642 may be configured to be in an opened state when radially outward of first portion 708, the opened state being a meta-stable state (e.g., meta-stable state referencing that locking ring 642 will remain in the opened state until able to revert to a closed state). Translation of first portion 708 through first opening 704 may cause first locking cap surface 702 to translate locking ring 642 towards locking recess 712. Upon translating substantially past first head stop 710, locking ring 642 may be radially outward of locking recess 712 and revert to a closed state. The opened state of locking ring 642 may be associated with an internal locking ring diameter substantially equal to puncher head diameter D3 and the closed state of locking ring 642 may be associated with the internal locking ring diameter being substantially equal to lock recess diameter D4. Accordingly, the closed state of locking ring 642 may cause locking ring 642 to substantially prevent additional translation of puncher head 646 through contact with first head stop 710 and/or second head stop 714 once puncher head 646 reaches the second position.

Sealing recess 716 may be at least partially defined by second head stop 714 and puncher head base plate 718. Additionally, sealing recess 716 may be configured to receive puncher internal seal 648 and form a substantially fluid-tight seal with channel lining 644 and puncher internal seal 648. It should be noted that while puncher internal seal 648 is depicted as a ring seal, puncher internal seal 648 and sealing recess 716 may refer to various additional embodiments (e.g., puncher internal seal 648 is a ridge seal adhered within sealing recess 716, sealing recess 716 is configured as a sealing surface that translates along an internal seal of channel lining 644, etc.).

Puncher head base plate 718 may extend radially outward from the central axis and be configured to contact primer cap 650. Additionally, puncher head base plate 718 may be configured such that the drive force applied to puncher head 646 is applied at least in part to puncher head 646 via puncher head base plate 718. Puncher head base plate 718 may be formed from a heat-resistant, pressure-resistant, shock-resistant, and/or otherwise durable material to substantially prevent deformation by the drive force.

Puncher drive 652 may be comprised of primer charge 720 and cap recess 722, and primer stop 724. Primer charge 720 may be a source of the driving force applied to puncher head 646, wherein primer charge 720 may be configured as a pyrotechnic charge, a pneumatic drive, an electric motor, a compressed spring, and/or other component capable of translating at least propellant cannister from the first position to the second position. Prior to puncher components 700 receiving an activation signal, primer cap 650 may be disposed at least partially within cap recess 722 and/or at least partially enclosing primer charge 720. For example, cap recess 722 may be configured with a cap recess diameter D5 substantially equal to a puncher cap diameter such that primer cap 650 is received by cap recess 722. Additionally, insertion of primer cap 650 within cap recess 722 may cause the drive force to be more efficiently applied from primer charge 720 to puncher head base plate 718. Accordingly, primer cap 650 and cap recess 722 may be configured to direct and apply the drive force to at least puncher head base plate 718.

Primer stop 724 may be configured to couple with channel lining 644 to substantially secure puncher drive 652 against translation along the central axis opposite to translation of propellant cannister 620. For example, upon installation within channel lining 644, primer stop 724 may be engaged by, contained by, and/or otherwise secured within puncher channel 638. Primer stop 724 may be configured as a protruding ridge that prevents movement past a matching ridge within puncher channel 638. Alternatively, or in addition, primer stop 724 may be configured to couple with internal cap wall 656 to prevent translation opposite to translation of propellant cannister 620. Generally, primer stop 724 may secure puncher drive 652 within and/or in association with puncher channel 638 such that the drive force generated by primer charge 720 is transferred to puncher head 646.

Channel lining 644 may comprise a first channel portion 726, a channel coupling surface 728, and a second channel portion 730. First channel portion 726 may be configured for insertion radially within second locking cap surface 706, wherein a channel lining diameter D6 is less than locking cap diameter D2 and greater than puncher head diameter D3. Additionally, first channel portion 726 may be configured to contain locking ring 642 between first locking cap surface 702 and first channel portion 726. For example, locking ring 642 may be placed radially coaxially within the second locking cap surface 706 such that insertion of first channel portion 726 radially within the second locking cap surface 706 substantially contains locking ring 642 while permitting puncher head 646 to extend through first opening 704, locking ring 642, and first channel portion 726. Further, first channel portion 726 may be permanently and/or removably secured within locking cap 640 by channel coupling surface 728. For example, and during assembly of puncher components 700, channel coupling surface 728 may be adhered, welded, coupled, connected, bolted, screwed, and/or otherwise combined with locking cap 640.

Locking cap coupling surface 732 may be configured to couple with channel coupling surface 728 to contain locking ring 642 in the open state while puncher head 646 is in the first position. As discussed above, first channel portion 726 of channel lining 644 may be inserted into locking cap 640, wherein locking ring 642 is disposed between first locking cap surface 702 and first channel portion 726. Locking cap coupling surface 732 may be secured to channel coupling surface 728 to substantially prevent displacement, translation, and/or other movement by locking cap 410 and/or locking ring 642 during translation of puncher head 646 from the first position to the second position. For example, puncher head 646 may be secured in the second position by locking ring 642 transitioning from the open state to the closed state and contacting at least one of first locking cap surface 702 and/or first channel portion 726. During assembly, puncher components 700 may be coupled together such that a housing of projectile launcher 100 or the propulsion module housing substantially prevents further translation along the central axis. Locking cap coupling surface 732 and channel coupling surface 728 may secure locking cap 640 to channel lining 644, channel lining 644 may be secured by internal cap wall 656 and external cap wall 668, and external cap wall 668 may be coupled to the propulsion module housing and/or projectile launcher 100.

Locking ring 642 may comprise locking ring interface 734, external locking ring surface 736, and internal locking ring surface 738. As noted by various above examples, locking ring 642 may be configured to substantially prevent further translation of puncher head 646, propellant cannister 620, and/or other components of propulsion module 600 once the second position is reached. Additionally, locking ring 642 may be configured to transition between the open state and the closed state, wherein the open state is associated with the first position of puncher head 646 and the close state is associated with the second position of puncher head 646. Further, locking ring 642 may be transitioned between the closed state and the open state via locking ring interface 734. Locking ring interface 734 may be utilized during installation and/or assembly of puncher components 700. For example, locking ring interface 734 may be configured as a first end and a second end that are disposed adjacent to each other in the closed position. The first end of locking ring interface 734 may further comprise a first loop and the second end of locking ring interface 734 may further comprise a second loop, wherein the first loop and the second loop can be utilized to leverage the first end and the second end apart to expand locking ring diameter D7 from the closed state to the open state. In the closed state, locking ring diameter D7 may be substantially equal to lock recess diameter D4. In the open state, locking ring diameter D7 may be substantially equal to puncher head diameter D3. Generally, locking ring interface 734 may enable locking ring 642 to be transitioned between the closed state and the open state independent of a position of puncher head 646.

External locking ring surface 736 and internal locking ring surface 738 may be configured to contact various lock stops and/or surfaces (e.g., first locking cap surface 702, first portion 708, first head stop 710, locking recess 712, second head stop 714, etc.) to limit and/or prevent translation of propellant cannister 620, puncher head 646, and/or other components configured to translate between the first position and the second position. Locking ring 642 may be configured such that external locking ring surface 736 and internal locking ring surface 738 are prevented from shearing past the opposing surface. For example, and during translation of puncher head 646 to the second position, external locking ring surface 736 may contact first opening 704 and internal locking ring surface 738 may contact second head stop 714. Due to the external locking ring surface 736 and internal locking ring surface 738 experiencing opposing forces (i.e., puncher head 646 momentum applies a first force towards propellant cannister 620 and first surface 702 applies a second force in response to the first force preventing locking ring 642 from passing through first opening 704), locking ring 642 experiences a shearing effect under the opposing forces. Accordingly, locking ring 642, external locking ring surface 736, and internal locking ring surface 738 may be configured to prevent deformation of locking ring 642 and translation of puncher head 646 past the second position.

Channel wall 740 of channel lining 644 may be configured to define the puncher channel and contain puncher head 646, puncher internal seal 648, primer cap 650, and/or puncher drive 652. Channel wall 740 may comprise channel diameter D8, wherein channel diameter is greater than or equal to puncher head diameter D3 and/or base plate diameter D9 associated with puncher head base plate 718. Additionally, channel wall 740 may be configured to permit puncher head 646 to translate from the first position to the second position while maintaining a substantially fluid-tight seal with puncher internal seal 648. Further, channel wall 740 may be configured to maintain alignment between a channel central axis (e.g., the central axis A) and a head central axis of puncher head 646 to substantially prevent seizure within the puncher channel (e.g., ensure that puncher head 646 does not becoming trapped within the puncher channel and prevented from translating from the first position to the second position).

Puncher drive 652 may comprise a drive contact 742 configured to form an electrical communication path with puncher connector 654. Drive contact 742 may be an electrically conductive portion of puncher drive 652 that receives the activation signal from the puncher connector 654 and causes the puncher drive 652 to generate the drive force. For example, drive contact 742 may be configured as a conductive plate that receives the activation signal, converts electrical energy of the activation signal into thermal energy, and enables thermal energy generated from the activation charge to set off primer charge 720 and provide the drive force. In various embodiments, the drive contact 742 may be configured as an electrical communication plate that receives the activation signal for puncher drive 652.

Puncher connector 654 may comprise a fail-close contact 744, wherein fail-close contact 744 may be configured such that the electrical communication path between puncher connector 654 and drive contact 742 is disconnected after the activation signal is transmitted. Fail-close contact 744 may be further configured as a single-use component that is replaced to reform the electrical communication path or a multi-use component that is reset to reform the electrical communication path. In various embodiments, fail-close contact 744 may transmit one or more signals prior to the activation signal to determine that the electrical communication path is formed upon assembly of propulsion module 600 and puncher components 700. The activation signal may be determined to satisfy a disconnect threshold associated with fail-close contact 744 disconnecting the electrical communication path while the one or more signals may be determined to not satisfy the disconnect threshold.

In various embodiments, fail-close contact 744 may be a component of puncher drive 652 disposed substantially adjacent to at least primer charge 720. As described above, fail-close contact may be configured such that the electrical communication path is altered after the activation signal is transmitted. Fail-close contact 744 may be configured to activate primer charge 720 such that primer charge 720 combusts and fail-close contact 744 disconnects the electrical communication path (e.g., a wire of fail-close contact 744 melts and breaks an electrical connection of the electrical communication path). Additionally, activation of primer charge 720 via fail-close contact 744 may deposit an amount of conductive material that completes the electrical communication path disconnected by fail-close contact 744. It should be noted that the amount of conductive material may be associated with a different resistance than a resistance associated with the fail-close contact 744.

Figure 8:
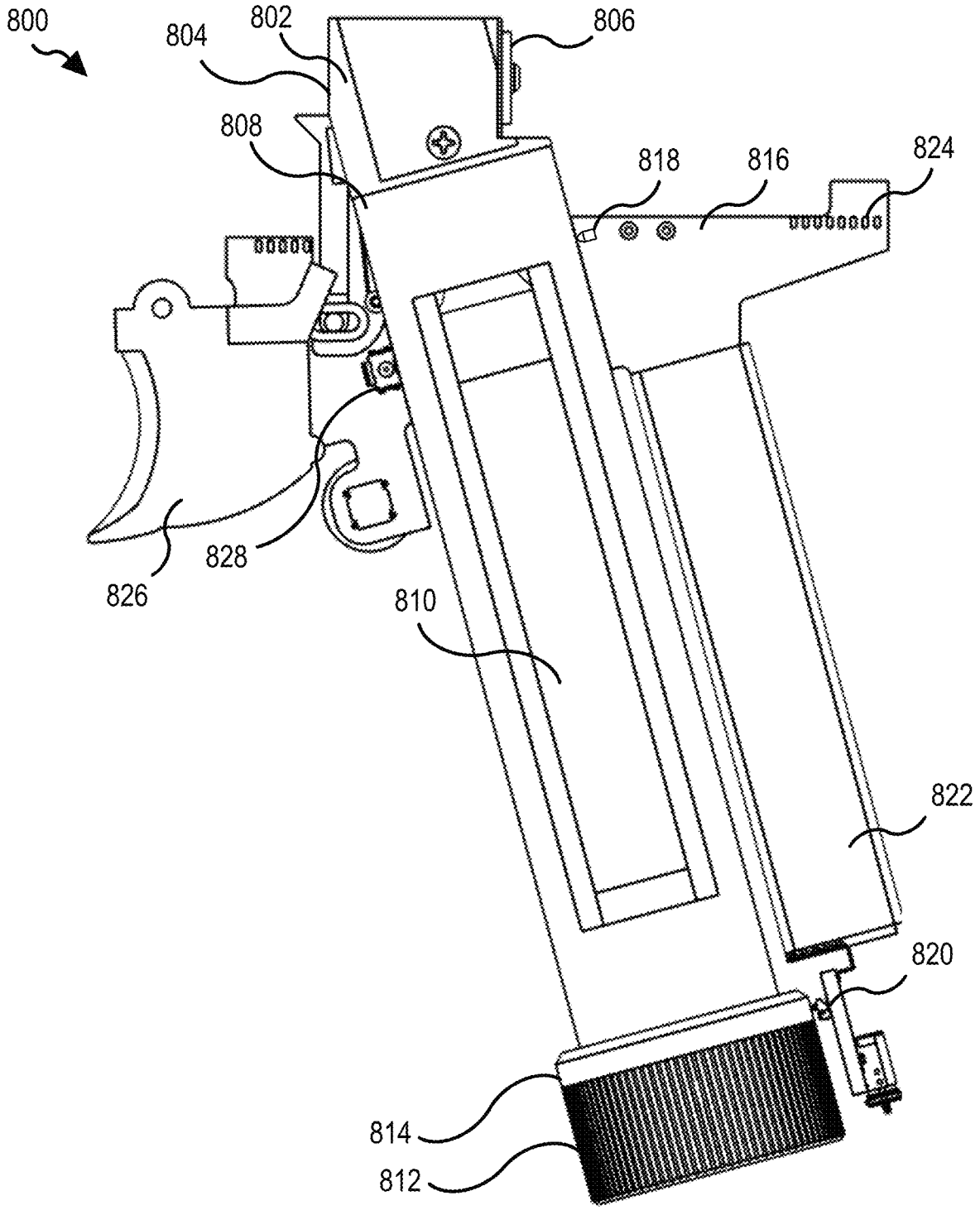
FIG. 8 is a perspective view of a propulsion module assembly for a projectile launcher, in accordance with various embodiments.

In various embodiments, and with reference to FIG. 8, propulsion system 800 of projectile launcher 100 may be comprised of a control circuit, a propulsion module, and various fluid control components. Propulsion system 800 may be similar to, or have similar aspects and/or components with, any propulsion system, propulsion module, and/or projectile launcher discussed herein. It should be noted that electrical components depicted and/or described with reference to FIG. 8 may be altered, modified, replaced, and/or otherwise iterated upon while providing substantially equivalent functionality. Accordingly, propulsion system 800 may be associated with a variety of control circuits dependent at least on a configuration of projectile launcher 100.

Propulsion system 800 may comprise propellant regulator housing 802, magazine interface 804, and propellant regulator 806. Propellant regulator housing 802 may be a portion of housing 102, propulsion module 400, and/or propulsion module 600. Additionally, propellant regulator housing may be configured to receive and/or couple with propulsion module housing 808 such that a fluid communication path may be formed between propellant cannister 810 and propellant regulator 806. For example, propulsion module housing 808 may be configured to be inserted into and/or couple with propellant regulator housing 802 such that internal components of the propulsion module (e.g., fluid channel 404, needle 412, etc.) form the fluid communication path that provides an amount of propellant from propellant cannister 810 to propellant regulator 806. Propellant regulator housing 802 may be configured to removably and/or permanently coupled with propulsion module housing 808. Further, propellant regulator housing 802 may be comprise a propellant module socket that receives and couples with propulsion module housing 808.

Propellant regulator housing 802 may be configured to contain and secure propulsion system components associated with projectile launcher 100. As noted above, propulsion system 800 may include magazine interface 804 and propellant regulator 806 that are disposed within propellant regulator housing 802. Magazine interface 804 and propellant regulator 806 may be integrated with propellant regulator housing 802 (e.g., sintered, welded, adhered, etc.) and/or secured at least partially within propellant regulator housing 802 (e.g., bolted, coupled, attached, etc.). Additionally, propellant regulator housing 802 may be configured to fluidly connect at least propellant regulator 806 with the propellant cannister 810 such that the amount of propellant may be provided for launching one or more projectiles P.

Magazine interface 804 may be similar to, or have similar aspects and/or components with, any magazine interface discussed herein (e.g., magazine interface 206, housing interface 208, etc.). Magazine interface 804 may be configured to receive and/or couple with a magazine for projectile launcher 100. Additionally, magazine interface 804 may be configured to communicate signals, indicators, electrical currents, propellants, and information between the magazine and projectile launcher 100. For example, inserting the magazine into projectile launcher 100 may enable launching of one or more projectiles P. Additionally, insertion of the magazine into projectile launcher 100 may cause a fluid communication path to be formed with propellant regulator 806 via magazine interface 804, an electrical communication path to be formed via magazine interface 804, and/or otherwise enable projectile launcher to communicate with the magazine.

Propellant regulator 806 may be configured to modulate provision of propellant from propellant cannister 810 to the magazine via magazine interface 804. For example, a fluid channel of propulsion module housing 808 (e.g., fluid channel 404) may provide propellant from propellant cannister 810 to propellant regulator 806, wherein propellant regulator 806 comprises one or more internal components that control a flow rate, a flow pressure, and other material properties of the propellant. Propellant regulator 806 may comprise valves, internal fluid channels, chambers, seals, throttling components, and other fluid regulating components.

Propulsion module housing 808, propellant cannister 810, and associated components may be configured in a manner similar to that described by FIGS. 4-7. Additionally, propulsion module housing 808 may be configured to insert within a handle or other portion of projectile launcher 100 such that a fluid channel may provide propellant from propellant cannister 810 to propellant regulator 806.

Propulsion module cap 812 may be similar to, or have similar aspects and/or components with, any cap and/or cap component discussed herein (e.g., propulsion module cap 432, internal cap wall 656, conductive plate 660, external cap wall 668, etc.). Additionally, and also similar to various cap components discussed herein, propulsion module cap 812 may be configured as a housing overmold that provides sufficient grip for a user of projectile launcher 100 to manipulate propulsion module cap 812 and, optionally, components of a propulsion module (e.g., propulsion module 210, propulsion module 400, propulsion module 600, etc.) directly or indirectly coupled to propulsion module cap 812. For example, the housing overmold of propulsion module cap 812 may be configured as a grip that permits a user of projectile launcher 100 to insert the propulsion module within the projectile launcher 100 and screw propulsion module cap 812 into a housing of projectile launcher 100.

Conductive ring 814 may be similar to, or have similar aspects and/or components with, any conductive ring discussed herein (e.g., conductive plate 434, conductive ring 662, etc.). Additionally, and similar to other conductive rings discussed herein, conductive ring 814 may be configured to form an electrical communication path with a puncher drive contact (e.g., primer contact 440, conductive plate 434, puncher contact, puncher drive contact, etc.). Further, and similar to other conductive rings discussed herein, conductive ring 814 may be configured to form an additional electrical communication path with at least one of propulsion module housing 808, propellant cannister 810, and/or an electrical circuit associated with the propulsion module.

A control circuit associated with propulsion system 800 may comprise control PCB 816, first propulsion module contact 818, second propulsion module contact 820, power source 822 (e.g., power supply 306), user interface contact 824 (e.g., user interface 304), activation trigger 826 (e.g., trigger 108), and/or activation sensor 828. Control PCB 816 may be configured as a circuit board that includes a processor, an amount of memory, and electrical communication paths for transmitting signals and indicators with and between various components of the control circuit. Additionally, control PCB 816 may be similar to, or have similar aspects and/or components with, any control circuit discussed herein (e.g., processing circuit 302). Further, control PCB 816 may comprise additional communication interfaces associated with a magazine, CEW circuits, and/or other components of projectile launcher 100. Control PCB 816 and components associated with control PCB 816 may be powered at least in part by power source 822, wherein power source 822 may be configured as a battery, a capacitor, and/or other power sources.

First propulsion module contact 818 may be configured such that a first electrical connection is formed between first propulsion module contact 818 and a portion of the propulsion module. The first electrical connection may be formed by first propulsion module contact 818 contacting propellent regulator housing 806, propulsion module housing 808, propellant cannister 810, and/or other components of the propulsion module upon assembly of propulsion system 800.

Second propulsion module contact 820 may be configured such that a second electrical connection is formed between the second propulsion module contact 818 and conductive ring 814. The second electrical connection may be formed upon installation of the propulsion module cap 812 securing the propulsion module in association with projectile launcher 100.

First propulsion module contact 818 and second propulsion module contact 820 may form at least a signal circuit that may be utilized to send a pilot signal, an activation signal, a test signal, and/or other signals associated with propulsion system 800. For example, first propulsion module contact 818 and second propulsion module contact 820 may be utilized to confirm successful installation of the propulsion module, successful installation of propulsion system 800, and other configuration determinations associated with propulsion system 800. Additionally, first propulsion module contact 818 and second propulsion module contact 820 may be utilized to transmit the activation signal to propulsion system 800 and cause the propellant regulator 806 to receive propellant from propellant cannister 810. Accordingly, first propulsion module contact 818 and second propulsion module contact 820 may be configured to enable electrical communication between control PCB 816 and at least the propulsion module of propulsion system 800.

Control PCB 816 may be configured to transmit and/or receive signals associated with user interface contact 824, wherein user interface contact 824 may be in electrical communication with one or more levers, switches, buttons, touch-screen interfaces, screens, indicators, and/or other interfaces for providing and/or receiving information associated with a user of projectile launcher 100. The one or more signals transmitted and/or received from user interface contact 824 may be associated with a state of projectile launcher 100 (e.g., a safe state, a firing state), a state of propulsion system 800 (e.g., pressurized state, unpressurized state, ready state, depleted state, etc.), and/or other states that are communicated to a user of projectile launcher 100. Accordingly, information and indications can be provided and acquired from the user via a user interface associated with user interface contact 824.

Control PCB 816 may be configured to receive an indication (e.g., a contact signal) that activation trigger 826 is depressed (e.g., pulled), wherein the indication may be activation sensor 828 in response to activation trigger 826 contacting activation sensor 828. The indication received from activation sensor 828 may cause control PCB 816 to transmit the activation signal to propulsion system 800. Additionally, the indication received from activation sensor 828 may cause control PCB 816 to utilize propellant provided by propulsion system 800 to launcher one or more projectiles associated with projectile launcher 100.

Figure 9A:
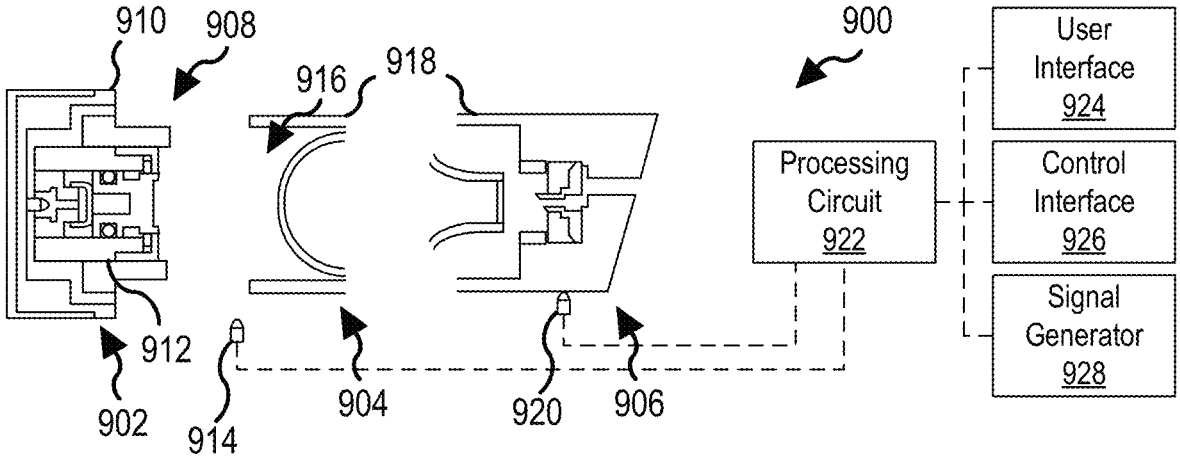
FIG. 9A is a schematic view of a propulsion module and an associated control system at a first time, in accordance with various embodiments.
Figure 9B:
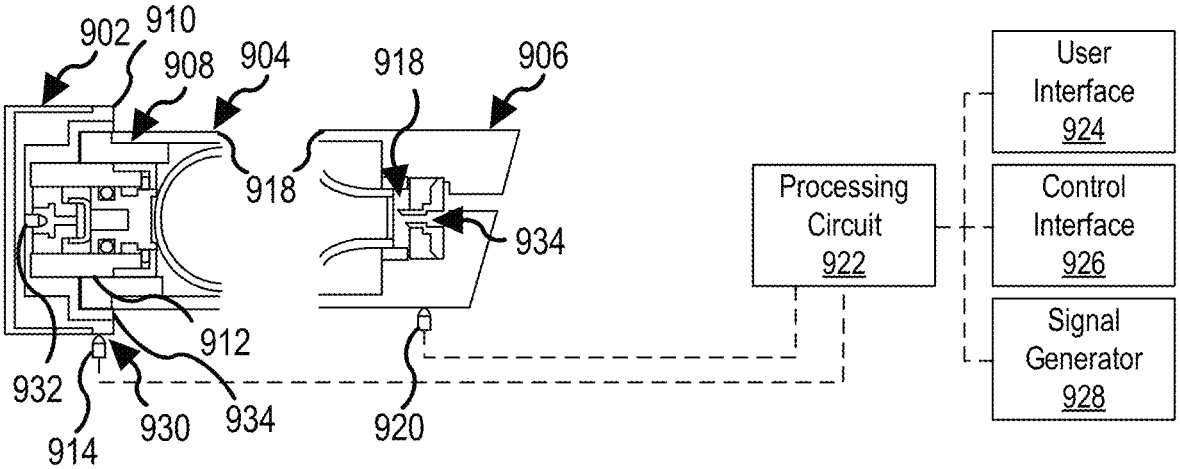
FIG. 9B is a schematic view of a propulsion module and an associated control system at a second time, in accordance with various embodiments.
Figure 9C:
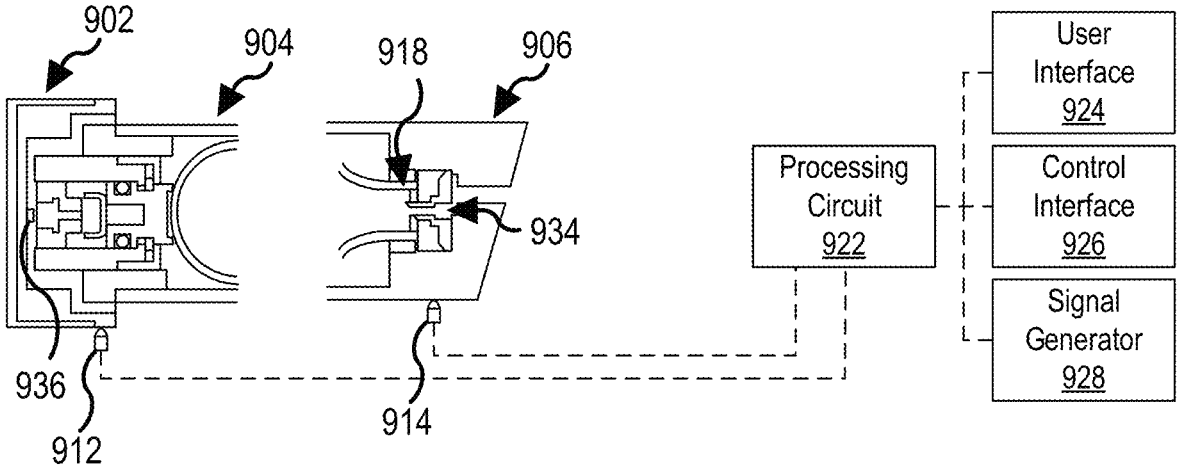
FIG. 9C is a schematic view of a propulsion module and an associated control system at a third time, in accordance with various embodiments.

In various embodiments, and with reference to FIG. 9A-9C, propulsion system 900 of projectile launcher 100 may be comprised of propulsion module cap 902, propulsion module base 904, propulsion module socket 906, one or more control components, and/or various fluid control components. Propulsion system 900 may be similar to, or have similar aspects and/or components with, any propulsion system, propulsion module, and/or projectile launcher discussed herein. It should be noted that electrical components depicted and/or described with reference to FIG. 8 may be altered, modified, replaced, and/or otherwise iterated upon while providing substantially equivalent functionality. Accordingly, propulsion system 900 may be associated with a variety of control circuits dependent at least on a configuration of projectile launcher 100.

Propulsion module cap 902 may be similar to, or have similar aspects and/or components with, any cap and/or cap component discussed herein (e.g., propulsion module cap 432, internal cap wall 656, conductive plate 660, external cap wall 668, propulsion module cap 812, etc.) Propulsion module cap 902 may comprise puncher drive 908 similar to or have similar aspects and/or components with, any puncher, piston, puncher drive, primer drive, and/or drive component described herein. Propulsion module cap 902 may further comprise a conductive plate 910 (e.g., conductive plate 434, conductive plate 660, etc.) in electrical communication with puncher drive 908 and/or puncher drive casing 912. Propulsion module cap 902 may be configured to form an electrical communication path between conductive plate 910 and first propulsion module contact 914. It should be noted that conductive plate 910 and first propulsion module contact 914 may be disconnected prior to assembly of propulsion system 900.

Propulsion module base 904 may be similar to, or have similar aspects and/or components with any propulsion module housing discussed herein (e.g., propulsion module housing 402, second portion 408, third portion 410, etc.). Propulsion module base 904 may be configured to receive at least a portion of propulsion module cap 902 within base opening 916. Base opening 916 may be configured to receive puncher drive 908 in proximity to a propellant cannister. Additionally, base opening 916 may be defined by propulsion module wall 918.

Propulsion module socket 906 may be similar to or have similar aspects and/or components with any propulsion module housing discussed herein (e.g., propulsion module housing 402, first portion 406, etc.). Propulsion module wall 918 may extend between propulsion module base 904 and propulsion module socket 906. Additionally, propulsion module wall 918 may be in electrical communication with second propulsion module contact 920. Propulsion module socket 906 may be configured to receive and/or couple with a neck portion of a propellant cannister. Additionally, propulsion module socket 906 may be configured to direct propellant from the propellant cannister to other components of projectile launcher 100.

Processing circuit 922 may be configured to transmit and receive signals associated with first propulsion module contact 914 and second propulsion module contact 920. Additionally, processing circuit 922 may be configured to transmit and receive signals associated with user interface 924 (e.g., user interface 304), control interface 926 (e.g., control interface 110), signal generator 928 (e.g., signal generator 308), and other control components of projectile launcher 100. In various embodiments, processing circuit 922 may be configured similar to or have similar aspects and/or components with any control circuit and/or processing circuit discussed herein (e.g., processing circuit 302). Further, processing 922 circuit may be configured to determine a current state of propulsion system 900 and modulate operation of various components associated with propulsion system 900.

Processing circuit 922 may be configured to determine the current status of propulsion system 900 via first propulsion module contact 914 and second propulsion module contact 920. In various embodiments, and as depicted by FIG. 9A, processing circuit 922 can determine that propulsion module cap 902 is disconnected, detached, and/or otherwise unassociated with propulsion module base 904 based at least on processing circuit 922 being unable to transmit a pilot signal between first propulsion module contact 914 and second propulsion module contact 920. When propulsion module cap 902 is unassociated with propulsion module base 904, no electrical communication path exists between first propulsion module contact 914 and second propulsion module contact 920. Additionally, processing circuit 922 may be configured to periodically (e.g., repeated transmission after a period of time has elapsed), aperiodically (e.g., repeated transmission based on an indicator), randomly (e.g., repeated transmission based on a programmatic determination), and/or responsively (e.g., transmission based on a threshold, input, and/or other control) transmit the pilot signal to determine whether signals may be transmitted via first propulsion module contact 914 and second propulsion module contact 920. Responsive to a determination that the pilot signal is unable to be transmitted, processing circuit 922 may determine that propulsion system 900 is inoperable, unassembled, faulty, and/or otherwise in an unusable state.

In various embodiments depicted by FIG. 9B, processing circuit 922 can determine that propulsion module cap 902 is connected, attached, and/or otherwise associated with propulsion module base 904 based at least on processing circuit successfully transmitting the pilot signal between first propulsion module contact 914 and second propulsion module contact 920. Successful association of propulsion module cap 902 with propulsion module base 904 may cause first propulsion module contact 914 to form an electrical communication path with exposed portion 930 (e.g., conductive ring 662) of conductive plate 910. Additionally, the electrical communication path may extend from conductive plate 910 to second propulsion module contact 920 via puncher contact 932 (e.g., primer contact 440, puncher connector 654, drive contact 742, etc.), puncher drive casing 912, propulsion module wall 918, and/or other components of propulsion system 900. Alternatively, or in addition, propulsion system 900 and components of propulsion system 900 (e.g., puncher drive casing 912, propulsion module wall 918, etc.) may comprise additional electrical components that form the electrical communication path between conductive plate 910 and second propulsion module contact 920 (e.g. wiring, electrical contacts, conductive material, etc.). Accordingly, processing circuit 922 may transmit and receive the pilot signal via first propulsion module contact 914 and second propulsion module contact 920 to determine that propulsion system 900 is in a ready, standby, assembled, and/or otherwise in an inactive, but operable state.

In various embodiments depicted by FIG. 9C, processing circuit may transmit an activation signal to puncher drive 908 via puncher contact 932 and determine that puncher drive 908 has activated and/or caused the propellant cannister to be in fluid communication with a fluid channel 934. Based at least on processing circuit 922 determining that the electrical communication path has been formed by first propulsion module contact 914 and second propulsion module contact 920, processing circuit may transmit the activation signal to puncher contact 932. The activation signal may cause puncher contact 932 to transition from a first state to a second state, wherein the first state forms the electrical communication path and the second state breaks the electrical communication path. The activation signal may have an activation current and/or an activation voltage greater than a pilot current and/or a pilot voltage of the pilot signal. As discussed above, the activation signal may cause puncher drive to translate between a first position and a second position. Further, transition from the first state of the puncher contact 932 to the second state may be associated with puncher contact 932 becoming tripped puncher contact 936 Accordingly, processing circuit 922 may utilize a first determination of the electrical communication path being formed followed by a second determination of the electrical communication path being broken after transmission of the activation signal to determine that the propulsion system 900 is in an active, firing, primed, pressurized, and/or otherwise able to launch one or more projectiles state.

In various embodiments, processing circuit 922 may utilize one or more electrical communication paths and/or one or more sensors to determine the current state of the propulsion system 900. For example, a first electrical communication path may electrically connect first propulsion module contact 914 with second propulsion module contact 920. As noted above, this may be utilized to determine whether propulsion module cap 902 is associated with propulsion module base 904 and whether the activation signal may be transmitted to puncher contact 932. Additionally, a second electrical communication path may be utilized to determine whether propulsion module cap 902 is associated with propulsion module base 904. First electrical communication path and second electrical communication path may be utilized to determine whether the propulsion module cap 902 is associated with the propulsion module base 904 (e.g., first path and second path both transmit and receive pilot signal), whether propulsion module cap 902 is unassociated with propulsion module base 904 (e.g., first path and second path both fail to transmit and receive pilot signal), and whether puncher drive has been activated (e.g., first path fails to transmit and receive pilot signal and second path transmits and receives pilot signal). Alternatively, processing circuit 922 may be associated with one or more sensors (e.g., pressure sensors, proximity sensors, contact sensors, etc.) that may be utilized in place of and/or in combination with the one or more electrical communication paths and/or to monitor system variables such as propellant pressure, propellant temperature, propellant flow rate, etc.

In various embodiments, processing circuit 922 may be utilized to execute various control paths and/or logic structures. For example, and at a first time, processing circuit may determine that a propulsion module is associated with a projectile launcher based at least on receipt of a contact signal and/or a pilot signal associated with a propulsion source housing. The contact signal may cause the processing circuit to further determine that the propulsion module is in a first state, the first state associated with a propellant source being fluidly sealed and in a first position. At a second time (or at the first time), processing circuit 922 may receive a control signal from control interface 926. In response to the control signal, processing circuit 922 may cause signal generator 928 to transmit an activation signal to puncher contact 932 (e.g., primer contact 440, puncher connector 654, an activation circuit associated with puncher contact 932, etc.). Further, and at a third time, processing circuit 922 may determine that the propulsion module is in a second state, the second state associated with the propellant source being fluidly connected with the projectile launcher and in a second position.

In various embodiments, processing circuit 922 may determine that the propulsion module is in the second state associated with the propellant source being fluidly connected with the projectile launcher and in the second position based at least on one or more additional signals. For example, and where puncher contact 932 is configured to electrically connect conductive plate 910 and an ignition plate (e.g., primer ignition plate 438), the one or more additional signals may not be transmitted in response to puncher contact 932 transitioning to tripped puncher contact 936. In response to tripped puncher contact 936 breaking an electrical connection between first propulsion module contact 914 and second propulsion module contact 920, the processing circuit 922 may not receive the one or more additional signals and determine that the propulsion module has transitioning to the second state at the third time. It should be noted that the determination may be at least partially dependent on a previous determination that at least a pilot signal and/or an activation signal was transmitted and/or received.

In various embodiments, processing circuit 922 may determine that the propulsion module is in the second state associated with the propellant source being fluidly connected with the projectile launcher and in the second position based at least on one or more additional signals. For example, and where puncher contact 932 is configured to electrically connect an ignition plate (e.g., primer ignition plate 438) and a propulsion module housing, the one or more additional signals may not be transmitted in response to puncher contact 932 transitioning to tripped puncher contact 936. In response to tripped puncher contact 936 breaking an electrical connection between first propulsion module contact 914 and second propulsion module contact 920, the processing circuit 922 may not receive the one or more additional signals and determine that the propulsion module has transitioning to the second state at the third time. It should be noted that the determination may be at least partially dependent on a previous determination that at least a pilot signal and/or an activation signal was transmitted and/or received.

In various embodiments, processing circuit 922 may determine that the propulsion module is in the second state associated with the propellant source being fluidly connected with the projectile launcher and in the second position based at least on one or more additional signals. For example, and where puncher contact 932 is configured to electrically connect an ignition plate (e.g., primer ignition plate 438) and a propulsion module housing, the one or more additional signals may be transmitted, in association with an altered resistance in response to puncher contact 932 transitioning to tripped puncher contact 936. Additionally, the one or more additional signals may be transmitted via a conductive material (e.g., conductive material 530) deposited by activation signal activating a drive force source. The processing circuit 922 may determine that the one or more additional signals transmitted via first propulsion module contact 914 and second propulsion module contact 920 is associated with an altered resistance and determine that the propulsion module has transitioning to the second state at the third time. It should be noted that the determination may be at least partially dependent on a previous resistance associated with at least a pilot signal and/or an activation signal.

User interface 924 and control interface 926 may be configured as an integrated interface and/or as separate interfaces. In various embodiments, user interface 924 may be configured to transmit and/or receive signals, information, indications, and/or other communications with a user of projectile launcher 100. Additionally, user interface 924 may comprise screens, touchscreens, LEDs, displays, and/or other components capable of exchanging information with the user. For example, user interface 924 may comprise a series of LEDs configured to communicate the current state of the projectile launcher (e.g., green LED may indicate that projectile launcher is ready to fire, red LED may indicate that projectile launcher is unable to fire, etc.), the current state of propulsion system 900 (e.g., green LED indicating that propulsion system 900 is supplying propellant, yellow LED indicating that propulsion system 900 is assembled and not supplying propellant, red LED indicating that propulsion system 900 is not assembled and/or has an error, etc.), and/or other indications associated with the projectile launcher.

As noted above, control interface 926 may be configured as an integrated interface with user interface 924 or as a separate interface. In various embodiments, control interface 926 may be configured to receive signals, information, indications, and/or other communications from a user associated with projectile launcher 100. Additionally, control interface 926 may comprise one or more triggers, levers, buttons, switches, touch-interfaces, dials, and/or other components capable of receiving one or more indications from the user. For example, control interface 926 may comprise a safety switch that is configured to switch projectile launcher 100 between at least a safe state and a firing state, the safe state being associated with projectile launcher 100 being substantially prevented from firing one or more projectiles P and the firing state being associated with projectile launcher 100 being capable of firing one or more projectiles P.

In various embodiments control interface 926 may be configured to transmit one or more indications (e.g., one or more control signals) to processing circuit 922. The one or more indications may cause processing circuit 922 to determine that a projectile launcher state has been updated, altered, should be updated, should be altered, and/or otherwise be changed. For example, switching control interface 926 to a safety state may alter the projectile launcher state (e.g., control interface 926 is configured to mechanically prevent a trigger of projectile launcher from firing one or more projectiles P) and transmit an indication that projectile launcher 100 is in the safety state to processing circuit 922. Alternatively, or in addition, switching control interface 926 to the safety state may transmit an indication to processing circuit 922 that causes processing circuit to alter the projectile launcher state such that the one or more projectiles P are substantially prevented from firing. Additionally, the one or more indications transmitted by control interface 922 may cause processing circuit to transmit one or more additional indications and/or signals. For example, the indication communicating that the projectile launcher is in the safety state may cause processing circuit to transmit an additional indication to user interface 924 such that user interface 924 displays that the projectile launcher is in the safety state to the user.

In various embodiments, control interface 926 may cause propellant to be provided from propulsion system 900 for launching the one or more projectiles P. For example, control interface 926 may be configured as a safety switch that comprises a first state associated with a safety state of projectile launcher 100, a second state associated with a firing state of projectile launcher 100, and a third state associated with activating propulsion system 900. After assembly of projectile launcher 100 and propulsion system 900, propulsion system 900 may be unable to provide propellant prior to receiving an activation signal from processing circuit 922. Switching control interface 926 from the first state to the second state may enable projectile launcher 100 to attempt launching one or more projectiles P. In at least one embodiment, switching control interface 926 from the first state to the second state may cause processing circuit 922 to transmit the activation signal to the propulsion system 900. In at least one additional embodiment, switching control interface 926 from the first state to the second state may not cause processing circuit 922 to transmit the activation signal. Further, the activation signal may be transmitted by processing circuit 922 in response to control interface 926 being switched to the third state. It should be further noted that the third state may be unassociated with enabling projectile launcher 100 to launch one or more projectiles P (e.g., switching control interface 926 to the third state may not place projectile launcher 100 in the firing state).

In various embodiments, control interface 926 may be configured as a trigger of projectile launcher 100 (e.g., trigger 108). Control interface 926 may be configured to cause processing circuit 922 to transmit the activation signal in response to a first depression of control interface 926 after assembly of propulsion system 922. For example, propulsion system 900 may be assembled such that propellant cannister is unable to provide propellant to projectile launcher 100. Processing circuit 922 may be configured to determine that propulsion system 900 is assembled, but fluidly disconnected from projectile launcher 100. Additionally, and in response to the first depression of control interface 926, processing circuit 922 may be configured to transmit the activation signal to propulsion system 900 and cause propulsion system 900 to become fluidly connected with projectile launcher 100. Further, the first depression of control interface 926 may further cause one or more projectiles P to be launched by projectile launcher 100 utilizing propellant received from propulsion system 900.

Signal generator 928 may be associated with at least processing circuit 922 to transmit one or more signals to internal components and systems of projectile launcher 100. In various embodiments, signal generator 928 may be configured to transmit one or more signals to components associated with projectile launcher 100 and/or propulsion system 900. The one or more signals may comprise a stimulus signal that is transmitted to one or more electrodes, a pilot signal that is transmitted to one or more electrical communication paths to verify connectivity, an activation signal that is transmitted to propulsion system 900, and other signals associated with projectile launcher functionality.

In various embodiments, signal generator 928 may be configured to generate and transmit the pilot signal and/or the activation signal to the processing circuit 922 via first propulsion module contact 914 and second propulsion module contact 920. For example, processing circuit 922 may transmit a pilot indication to signal generator 928 and cause signal generator 928 to transmit the pilot signal to the processing circuit 922 via first propulsion module contact 914 and second propulsion module contact 920. Processing circuit 922 may determine that propulsion system 900 is assembled based on the pilot indication being sent to the signal generator 928 and the signal generator 928 responding via first propulsion module contact 914 and second propulsion module contact 920. Similarly, processing circuit 922 may transmit an activation indication to signal generator 928 and cause signal generator 928 to transmit the activation signal to the processing circuit 922 via first propulsion module contact 914 and second propulsion module contact 920. Processing circuit 922 may determine that the propulsion source is fluidly connected with projectile launcher 100 based the activation indication being sent to the signal generator 928 and the signal generator 928 responding via first propulsion module contact 914 and second propulsion module contact 920 and subsequent pilot indications not causing an associated pilot signal to be received by processing circuit 922.

In various embodiments a propulsion system may comprise a puncher casing, a puncher drive, a puncher head, and a puncher lock. The puncher casing may comprise a first end opposite a second end and a puncher channel extending at least partially between the first end and the second end. The puncher drive may be located proximate to the first end of the puncher casing and in communication with the puncher channel. The puncher head may be located proximate to the first end of the puncher casing within the puncher channel, wherein the puncher head is configured to translate from the first end to the second end responsive to a drive force and via the puncher channel. Additionally, the drive force may be generated within the puncher channel by the puncher drive based at least in part on an activation signal. The puncher lock may be configured to secure the puncher head proximate to the second end. The puncher lock may comprise a locking ring. The puncher lock may be located proximate to the second end of the puncher casing within the puncher casing.

In various embodiments, a puncher casing may further comprise a channel wall and a puncher casing cap. The channel wall may be configured to define the puncher channel and contain the drive force. The puncher casing cap may be configured to define a lock recess and a lock stop, the lock recess configured to contain the puncher lock in a first position at a first time and the lock stop configured to secure the puncher lock and puncher head in a second position at a second time. At the first time, the puncher head may be proximate to the first end, the puncher lock may be in the first position based at least in part on the puncher head being proximate to the first end, and the puncher lock may be contained within the lock recess radially outside of the puncher head. At the second time, the puncher head may be proximate to the second end, the puncher lock may be in the second position based at least in part on the puncher head being proximate to the second end, and the puncher lock may extend from the lock recess between the first end and the puncher head.

In various embodiments, a puncher drive may be configured to translate the puncher head from a first position proximate to the first end to a second position proximate to the second end. A puncher head may be associated with a propellant cannister and may receive a drive force from the puncher drive, wherein the puncher drive may generate the drive force to translate the puncher head and the propellant cannister from the first position to the second position. Additionally, translation of the puncher head from the first position to the second position causes the propellant cannister to couple with a propulsion system. The puncher head may further comprise a puncher head seal recess configured to receive a puncher head seal and secure the puncher head seal proximate to an inner wall of the puncher casing. The puncher head seal may be configured to fluidly isolate a first volume of the puncher channel between the first end and the puncher head from a second volume of the puncher channel between the second end and the puncher head. Further, the puncher head seal may be configured to translate from the first end to the second end as the first volume expands based at least on the drive force.

In various embodiments, a puncher head may comprise a puncher lock recess configured to receive a portion of a puncher lock. The puncher lock may be disposed radially outward of the puncher head and be configured to couple with the puncher lock recess based at least on the puncher head translating from the first end to the second end.

In various embodiments, a puncher drive may comprise a puncher drive cap, a drive force source (e.g., a primer charge, a drive charge, etc.), and a drive activator. The puncher drive cap may be disposed substantially adjacent to the first end of the puncher casing and the puncher channel. The drive force source configured to provide the drive force to a puncher head and a propellant source. The drive activator may be configured to receive an activation signal and cause the drive force source to apply the drive force to the drive head. Additionally, the drive force source may be a single use charge that provides the drive force via expanding gases within the puncher channel and the drive activator is further configured to ignite the drive force source.

In various embodiments, a propulsion system for a projectile launcher may comprise a propulsion source, a puncture structure, and a puncher. The propulsion source may comprise a first end, a second end opposite the first end, and a propulsion source wall. The puncture structure may be configured to include and/or associated with a fluid channel and located proximate to the first end. The puncher may be located proximate to the second end and configured to translate the propulsion source from a first position to a second position. Additionally, the propulsion source may be fluidly isolated from the puncture structure in the first position. Further, the propulsion source may be fluidly connected to the fluid channel of the puncture structure in the second position.

In various embodiments, a propulsion system may comprise a propulsion source housing having a recess shaped to receive the propulsion source and removably secure the propulsion source proximate to the puncture structure. The propulsion source housing may be coupled to a projectile launcher. Additionally, the propulsion source housing may fluidly connect the fluid channel of the puncture structure with a propulsion module of the projectile launcher. Further, the propulsion source housing may comprise a bottom end and a top end, the bottom end having an opening associated with the recess and the top end including the puncture structure. The propulsion source may be removably secured within the propulsion housing source by a housing cap that couples with the opening. The opening associated with the bottom end and the recess may comprise a coupling mechanism configured to removably couple with and secure a housing cap, wherein the puncher is secured at least partially within the housing cap adjacent to the second end of the propulsion source.

In various embodiments, a puncher control circuit may be in electrical communication with a puncher via a puncher activator. The puncher activator may be associated with the puncher and configured to receive an activation signal from the puncher control circuit, the puncher activator further configured to cause the puncher to translate the propulsion source from the first position to the second position in response to receiving the activation signal. Translation of the propulsion source from the first position to the second position may cause the puncture structure to puncture the propulsion source wall and fluidly connect the propulsion source with the fluid channel of the puncture structure. The propulsion source and the fluid channel may be fluidly connected based at least in part on the puncture structure extending through the propulsion source wall.

In various embodiments, a puncher housing may comprise a housing overmold, a puncher contact, and a puncher activator. The housing overmold may be configured to selectively expose a portion of the puncher contact and comprises an electrically non-conductive material. The puncher contact may be in electrical communication with the puncher activator and comprises an electrically conductive material.

In various embodiments, a processing circuit and/or a control circuit may be configured to execute one or more methods. For example, a first method step may comprise determining, based at least in part on a pilot signal associated with a propulsion source housing, that a propulsion module is associated with a projectile launcher. In response to determining that the propulsion module is associated with the projectile launcher, the processing circuit may determine that the propulsion module is in a first state, the first state associated with a propellant source being fluidly sealed and in a first position. A second method step may comprise the processing circuit receiving a control signal from a control interface associated with the projectile launcher. In response to the control signal, the processing circuit may cause an activation signal to be transmitted to an activation circuit or a puncher activator associated with a puncher of the propulsion module. A third method step may comprise the processing circuit determining that the propulsion module is in a second state, the second state associated with the propellant source being fluidly connected with the projectile launcher and in a second position.

In various embodiments, a processing circuit may be associated with one or more user interfaces and control interfaces. The processing circuit may transmit, based on a determination that the propulsion module is in the first state, a first indication that the propulsion module is in an inactive state to a user interface associated with the projectile launcher. Similarly, the processing circuit may transmit, based on a determination that the propulsion module is in the second state, a second indication that the propulsion module is in an active state to the user interface. The control interface may be configured as a projectile launcher safety and may transmit the control signal based at least on the projectile launcher safety switching from a safety mode to a firing mode. Alternatively, or in addition, the control interface may be configured as a projectile launcher trigger and may transmit the control signal based at least on the projectile launcher trigger being at least partially depressed.

In various embodiments, the pilot signal may be generated by a projectile launcher controller associated with the processing circuit based at least on an electrical contact path formed by the propulsion source housing coupling with the projectile launcher. The processing circuit may determine that the propulsion module is in the first state based at least on the pilot signal being received at a first time and the control signal not being received at a second time, wherein the second time is after the first time. Additionally, the processing circuit may determine that the propulsion module is in the second state based at least on the pilot signal has been received by the projectile launcher controller at a first time, the control signal being received at a second time, and the pilot signal being unavailable at the second time, wherein the second time is after the first time.

In various embodiments, a propulsion module cap may comprise a puncher activation contact, a puncher activation plate, and a primer overmold. The puncher activation contact may be configured to electrically connect with a propulsion module puncher at a first time and electrically disconnect with the propulsion module puncher at a second time. The puncher activation plate may be in electrical communication with the puncher activation contact, the puncher activation plate having a contact ring and a connector plate that extends between the contact ring and the puncher activation contact. The primer overmold may be configured to selectively expose the contact ring. Additionally, the propulsion module cap may further comprise a primer cap liner configured to selectively expose the contact ring in combination with the primer overmold. The primer overmold may be located proximate to a first surface of the puncher activation plate and the puncher activation contact/the primer cap liner may be located proximate to a second surface of the puncher activation plate, the second surface being substantially opposite the first surface. Further, the primer overmold, the puncher activation plate, and the primer cap liner may be configured to share a central axis such that the primer overmold is disposed radially external to at least a portion of the connector plate and the primer cap liner is disposed radially internal to at least a portion of the contact ring. It should be noted that the primer overmold and the primer cap liner may be formed from an electrically non-conductive material and the puncher activation plate may be formed from an electrically conductive material.

In various embodiments, a puncher activation contact may be modified from a first state at the first time to a second state at the second time by an activation signal, wherein the activation signal is received via the contact ring of the puncher activation plate. Additionally, the primer overmold may be further configured to couple with a portion of a projectile launcher. The first state may be configured as a conductive state associated with an electrical communication path between the puncher activation contact and the propulsion module puncher. The second state is a nonconductive state associated with the puncher activation contact being electrically isolated from the propulsion module puncher.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosures. The scope of the disclosure is accordingly to be limited by nothing other than the appended claims and their legal equivalents, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B, and C may be present in a single embodiment; for example, A and B, A and C, B and C, or A and B and C.

Systems, methods, and apparatus are provided herein. In the detailed description herein, references to "various embodiments," "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments. Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A puncher system associated with a propulsion system for a projectile launcher, the puncher system comprising:

a puncher casing having a first end opposite a second end and a puncher channel extending at least partially between the first end and the second end;

a puncher drive being proximate to the first end of the puncher casing and in communication with the puncher channel;

a puncher head being proximate to the first end of the puncher casing within the puncher channel, wherein the puncher head is configured to translate from the first end to the second end responsive to a drive force and via the puncher channel;

a puncher lock being proximate to the second end of the puncher casing within the puncher casing, wherein the puncher lock is configured to secure the puncher head proximate to the second end; and a puncher casing cap of the puncher casing is configured to define a lock recess and a lock stop, the lock recess configured to contain the puncher lock in a first position at a first time and the lock stop configured to secure the puncher lock and the puncher head in a second position at a second time.

2. The puncher system of claim 1, wherein:

the puncher head is proximate to the first end at the first time; and the puncher lock is in the first position based at least in part on the puncher head being proximate to the first end and is contained within the lock recess radially outside of the puncher head at the first time.

3. The puncher system of claim 1, wherein:

the puncher head is proximate to the second end at the second time; and the puncher lock is in the second position based at least in part on the puncher head being proximate to the second end and extends from the lock recess between the first end and the puncher head at the second time.

4. The puncher system of claim 1, wherein:

the puncher drive is configured to translate the puncher head from the first position proximate to the first end to the second position proximate to the second end;

the puncher head is associated with a propellant cannister, wherein the drive force is generated by the puncher drive to translate the puncher head and the propellant cannister; and the puncher head translates from the first position to the second position to cause the propellant cannister to couple with the propulsion system.

5. The puncher system of claim 1, the puncher head further comprising a puncher head seal recess configured to receive a puncher head seal and secure the puncher head seal proximate to an inner wall of the puncher casing, wherein:

the puncher head seal fluidly isolates a first volume of the puncher channel between the first end and the puncher head from a second volume of the puncher channel between the second end and the puncher head; and the puncher head seal is configured to translate from the first end to the second end as the first volume expands based at least on the drive force.

6. The puncher system of claim 1, the puncher head further comprising a puncher lock recess configured to receive a portion of the puncher lock.

7. The puncher system of claim 6, wherein:

the puncher lock is disposed radially outward of the puncher head; and the puncher lock is configured to couple with the puncher lock recess based at least on the puncher head translating from the first end to the second end.

8. The puncher system of claim 1, the puncher drive further comprising:

a puncher drive cap disposed substantially adjacent to the first end of the puncher casing and the puncher channel;

a drive force source configured to provide the drive force; and a drive activator configured to receive an activation signal and cause the drive force source to apply the drive force to the puncher head.

9. The puncher system of claim 1, wherein the puncher drive provides the drive force responsive to an activation signal; and the puncher head is configured to transition from a first state to a second state responsive to the drive force, the first state associated with the puncher head being disposed proximate to the first end and the second state associated with the puncher head being disposed proximate to the second end.

10. The puncher system of claim 9, wherein:

the puncher lock is contained in the first position within the lock recess radially outside of the puncher head in the first state; and the puncher lock in the second position extends from the lock recess towards the puncher head in the second state.

11. The puncher system of claim 9, wherein:

the first state comprises the puncher head disposed in the first position proximate to the first end;

the second state comprises the puncher head disposed in the second position proximate to the second end;

the drive force generated by the puncher drive translates the puncher head and a propellant cannister; and the puncher head translates from the first position to the second position to cause the propellant cannister to couple with the propulsion system.

12. The puncher system of claim 9, wherein the puncher casing is configured as a puncher cap, the puncher cap comprising:

a puncher activation contact configured to electrically connect with the puncher drive and the puncher head in the first state and electrically disconnect from the puncher drive and the puncher head in the second state;

a puncher activation plate in electrical communication with the puncher activation contact, the puncher activation plate having a contact ring and a connector plate that extends between the contact ring and the puncher activation contact; and a primer overmold configured to selectively expose the contact ring.

13. The puncher system of claim 12, the puncher cap further comprising a primer cap liner configured to selectively expose the contact ring in combination with the primer overmold, wherein:

the primer overmold is proximate to a first surface of the puncher activation plate; and the puncher activation contact and the primer cap liner are proximate to a second surface of the puncher activation plate, the second surface being substantially opposite the first surface.

14. The puncher system of claim 12, wherein the activation signal transitions the puncher head from the first state to the second state and modifies the puncher activation contact to electrically disconnect from at least the puncher drive and the puncher head.

15. The puncher system of claim 14, wherein:

the puncher activation contact is in a conductive state while the puncher head is in the first state; and the puncher activation contact is in a nonconductive state and electrically isolated from the puncher head in the second state.

16. The puncher system of claim 9, further comprising a control interface, wherein:

the control interface determines that the puncher head is in the first state based at least on a pilot signal; and the control interface determines that the puncher head is in the second state based at least on receipt of the pilot signal and transmission of the activation signal.

17. The puncher system of claim 16, wherein:

the control interface is a projectile launcher safety of the projectile launcher; and the activation signal is transmitted based at least in part on the projectile launcher safety switching from a safety mode to a firing mode.

18. The puncher system of claim 16, wherein:

the control interface is a projectile launcher trigger of the projectile launcher; and the activation signal is transmitted based at least in part on the projectile launcher trigger being at least partially depressed.

19. The puncher system of claim 1, wherein the puncher channel is defined by the puncher casing cap proximate to the second end and a channel lining proximate to at least the first end.

20. The puncher system of claim 19, wherein the lock recess is defined longitudinally between the puncher casing cap and the channel lining.

* * * * *